United States Patent [19]

Tsiang et al.

[11] 4,169,439

[45] Oct. 2, 1979

[54] CIRCUIT MEANS AND APPARATUS FOR CONTROLLING THE AIR-FUEL RATIO SUPPLIED TO A COMBUSTION ENGINE

[75] Inventors: Chong L. Tsiang, Utica; Kenneth C. Bier, Bloomfield Hills, both of Mich.

[73] Assignee: Colt Industries Operating Corp., New York, N.Y.

[21] Appl. No.: 768,053

[22] Filed: Mar. 21, 1977

[51] Int. Cl.[2] ..... F02B 33/00

[52] U.S. Cl. ..... 123/119 EC; 123/119 R

[58] Field of Search ..... 123/119 EC, 139 AW, 123/119 R, 124 R, 119 D, 32 ED, 32 EK; 60/276, 285

[56] References Cited

U.S. PATENT DOCUMENTS

| | | | |
|---|---|---|---|
| 3,680,318 | 8/1972 | Nakajima et al. | 60/278 |
| 3,759,232 | 9/1973 | Wahl et al. | 123/32 EA |
| 3,782,347 | 1/1974 | Schmidt et al. | 123/119 R |
| 3,866,588 | 2/1975 | Nakada et al. | 123/124 R |
| 3,906,910 | 9/1975 | Szlaga, Jr. | 123/119 EC |
| 3,911,884 | 10/1975 | Moriya et al. | 123/139 AW |
| 3,926,154 | 12/1975 | Williams | 123/32 EE |
| 3,938,075 | 2/1976 | Reddy | 123/32 EK |
| 3,963,009 | 6/1976 | Mennesson | 123/119 D |

*Primary Examiner*—Charles J. Myhre
*Assistant Examiner*—R. A. Nelli
*Attorney, Agent, or Firm*—Walter Potoroka, Sr.

[57] ABSTRACT

A carbureting type fuel metering apparatus has an induction passage into which fuel is fed by several fuel metering systems among which are a main fuel metering system and an idle-fuel metering system, as generally known in the art; electrical circuit means responsive to signals produced by associated engine exhaust gas analyzing means sensitive to selected constituents of such exhaust gas and also responsive to other selected indicia of vehicle and/or engine operating conditions, creates feedback signal means which through associated transducer means become effective for controllably modulating the metering characteristics of the main fuel metering system and the idle fuel metering system.

45 Claims, 12 Drawing Figures

CIRCUIT MEANS AND APPARATUS FOR CONTROLLING THE AIR-FUEL RATIO SUPPLIED TO A COMBUSTION ENGINE

BACKGROUND OF THE INVENTION

Even though the automotive industry has over the years, if for no other reason than seeking competitive advantages, continually exerted substantial efforts to increase the fuel economy of automotive engines, the gains continually realized thereby have been deemed by various levels of governments as being insufficient. Further, such levels of government have also imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, the available technology employable in attempting to attain increases in engine fuel economy is generally, contrary to that technology employable in attempting to meet the governmentally imposed standards on exhaust emissions.

For example, the prior art, in trying to meet the standards for $NO_x$ emissions, has employed a system of exhaust gas recirculation whereby at least a portion of the exhaust gas is re-introduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for burning.

The prior art has also proposed the use of fuel metering means which are effective for metering a relatively overly-rich (in terms of fuel) fuel-air mixture to the engine combustion chamber means as to thereby reduce the creation of $NO_x$ within the combustion chamber. The use of such overly-rich fuel-air mixtures results in a substantial increase in CO and HC in the engine exhaust, which, in turn, requires the supplying of additional oxygen, as by an associated air pump, to such engine exhaust in order to complete the oxidation of the CO and HC prior to its delivery into the atmosphere.

The prior art has also heretofore proposed retarding of the engine ignition timing as a further means for reducing the creation of $NO_x$. Also, lower engine compression ratios have been employed in order to lower the resulting combustion temperature within the engine combustion chamber and thereby reduce the creation of $NO_x$.

The prior art has also proposed the use of fuel metering injection means instead of the usually-employed carbureting apparatus and, under superatmospheric pressure, injecting the fuel into either the engine intake manifold or directly into the cylinders of a piston type internal combustion engine. Such fuel injection systems, besides being costly, have not proven to be generally successful in that the system is required to provide metered fuel flow over a very wide range of metered fuel flows. Generally, those injection systems which are very accurate at one end of the required range of metered fuel flows, are relatively inaccurate at the opposite end of that same range of metered fuel flows. Also, those injection systems which are made to be accurate in the mid-portion of the required range of metered fuel flows are usually relatively inaccurate at both ends of that same range. The use of feedback means for altering the metering characteristics of a particular fuel injection system have not solved the problem because the problem usually is intertwined with such factors as: (a) effective aperture area of the injector nozzle; (b) comparative movement required by the associated nozzle pintle or valving member; (c) inertia of the nozzle valving member; and (d) nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits of, for example, 1.0 gram/mile of $NO_x$ (or even less).

The prior art, in view of such anticipated requirements with respect to $NO_x$, has suggested the employment of a "three-way" catalyst, in a single bed, within the stream of exhaust gases as a means of attaining such anticipated exhaust emission limits. Generally, a "three-way" catalyst (as opposed to the "two way" catalyst system well known in the prior art) is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively, but the oxidation of CO will be incomplete. On the other hand, if the fuel metering is too lean, the CO will be effectively oxidized but the reduction of $NO_x$ will be incomplete. Obviously, in order to make such a "three-way" catalyst system operative, it is necessary to have very accurate control over the fuel metering function of associated fuel metering supply means feeding the engine. As hereinbefore described, the prior art has suggested the use of fuel injection means with associated feedback means (responsive to selected indicia of engine operating conditions and parameters) intended to continuously alter or modify the metering characteristics of the fuel injection means. However, at least to the extent hereinbefore indicated, such fuel injection systems have not proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedback means cannot, at least as presently conceived, provide the degree of accuracy required in the metering of fuel to an associated engine as to assure meeting, for example, the said anticipated exhaust emission standards.

Accordingly, the invention as disclosed, described and claimed is directed generally to the solution of the above and related problems and more specifically to circuit means, structure, apparatus and systems enabling a carbureting type fuel metering device to meter fuel with an accuracy at least sufficient to meet the said anticipated standards regarding engine exhaust gas emissions.

SUMMARY OF THE INVENTION

According to the invention, a carburetor having an induction passage therethrough with a venturi therein has a main fuel discharge nozzle situated generally within the venturi and a main fuel metering system communicating generally between a fuel reservoir and the main fuel discharge nozzle. An idle fuel metering system communicates generally between a fuel reservoir and said induction passage at a location generally in close proximity to variably openable throttle valve situated in said induction passage downstream of the main fuel discharge nozzle. Electrical circuit means are provided for sensing the oxygen content of the exhaust gases and in turn controlling valving means which are provided to controllably alter the rate of metered fuel flow through each of said main and idle fuel metering systems in response to control signals generated in said circuit means.

Various general and specific objects and advantages of the invention will become apparent when reference is made to the following detailed description of the invention considered in conjunction with the accompanying drawings.

BRIEF DESCRIPTION OF THE DRAWINGS

In the drawings wherein for purposes of clarity certain details and/or elements may be omitted from one or more views.

DETAILED DESCRIPTION OF THE PREFERRED EMBODIMENT

Figure 1:
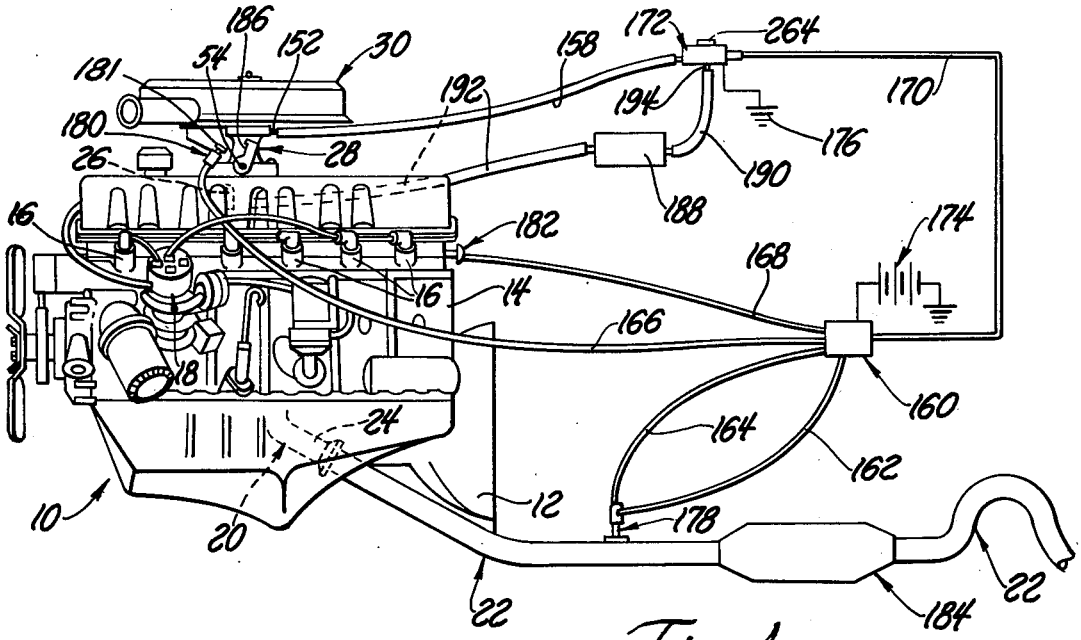
FIG. 1 illustrates, in side elevational view, a vehicular combustion engine employing a carbureting apparatus and an electrical control system embodying teachings of the invention.

Referring now in greater detail to the drawings, FIG. 1 illustrates a combustion engine 10 used, for example, to propell an associated vehicle as through power transmission means fragmentarily illustrated at 12. The engine 10, for example, may be of the internal combustion type employing, as is generally well known in the art, a plurality of power piston means therein. As generally depicted, the engine assembly 10 is shown as being comprised of an engine block 14 containing, among other things, a plurality of cylinders respectively reciprocatingly receiving said power pistons therein. A plurality of spark of ignition plugs 16, usually one for each cylinder, are carried by the engine block and respectively electrically connected to an ignition distributor assembly or system 18 operated in timed relationship to engine operation.

As is generally well known in the art, each cylinder containing a power piston has exhaust aperture or port means and such exhaust port means communicate as with an associated exhaust manifold which is fragmentarily illustrated in hidden line at 20. Exhaust conduit means 22 is shown operatively connected to the discharge end 24 of exhaust manifold 20 and leading as to the rear of the associated vehicle for the discharging of exhaust gases to the atmosphere.

Further, as is also generally well known in the art, each cylinder which contains a power piston also has inlet aperture means or port means and such inlet aperture means communicate as with an associated inlet manifold which is fragmentarily illustrated in hidden line at 26.

As generally depicted, a carbureting type fuel metering apparatus 28 is situated atop a cooperating portion of the inlet or intake manifold means 26. A suitable inlet air cleaner assembly 30 may be situated atop the carburetor assembly 28 to filter the air prior to its entrance into the inlet of the carburetor 28.

Figure 2:
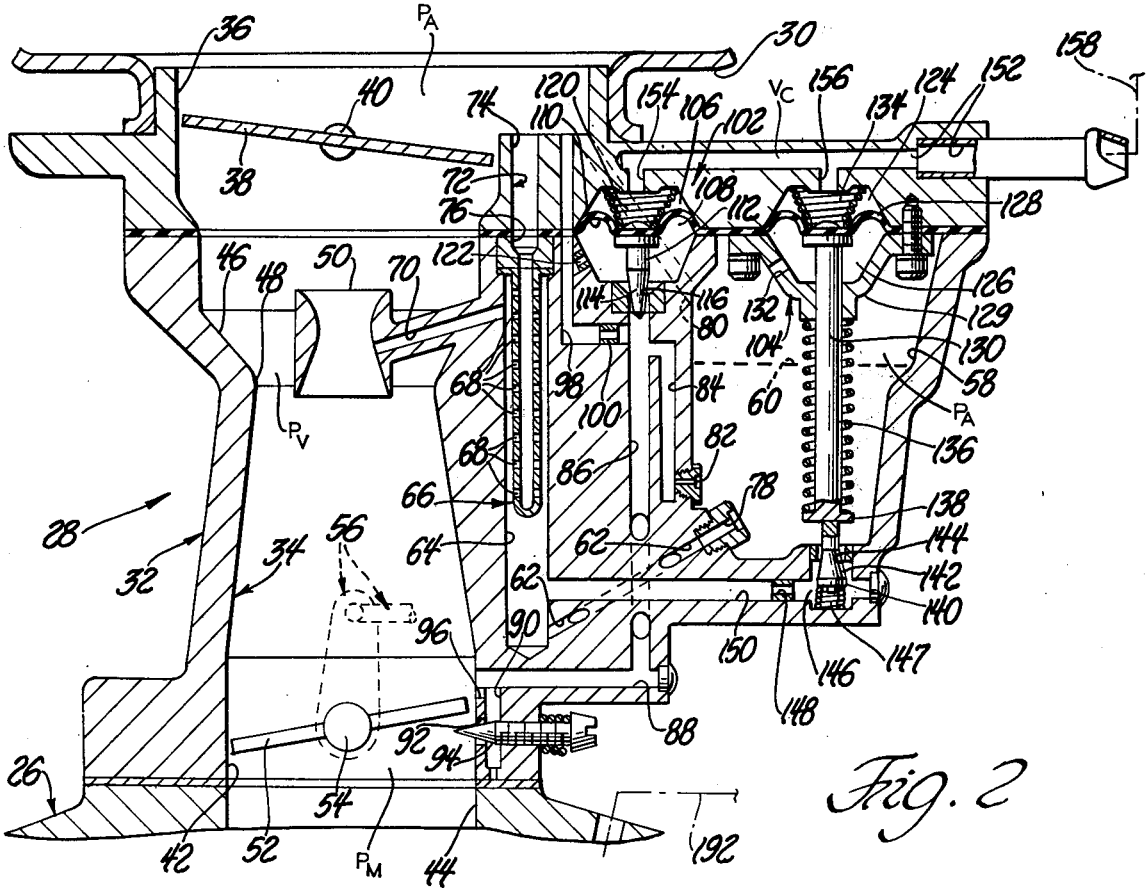
FIG. 2 is an enlarged view, in cross-section, of the carburetor of FIG. 1.

As generally shown in FIG. 2, the carburetor 28, employing teachings of the invention, comprises a main carburetor body 32 having induction passage means 34 formed therethrough while an upper inlet end 36, in which generally is situated a variably openable choke valve 38 carried as by a pivotal choke shaft 40, and a discharge end 42 communicating as with the inlet 44 of intake manifold 26. A venturi section 46, having a venturi throat 48, is provided within the induction passage means 34 generally between the inlet 36 and outlet or discharge end 42. A main metering fuel discharge nozzle 50, situated generally within the throat 48 of venturi section 46, serves to discharge fuel, as is metered by the main metering system, into the induction passage means 34.

A variably openable throttle valve 52, carried as by a rotatable throttle shaft 54, serves to variably control the discharge and flow of combustible (fuel-air) mixtures into the inlet 44 of intake manifold 26. Suitable throttle control linkage means, as generally depicted at 56, is provided and operatively connected to throttle shaft 54 in order to affect throttle positioning in response to vehicle operator demand. The throttle valve, as will become more evident, also serves to vary the rate of fuel flow metered by the associated idle fuel metering system and discharged into the induction passage means.

Carburetor body means 32 may be formed as to also define a fuel reservoir chamber 58 adapted to contain fuel 60 therein the level of which may be determined as by, for example, a float operated fuel inlet valve assembly, as is generally well known in the art.

The main fuel metering system comprises passage or conduit means 62 communicating generally between fuel chamber 58 and a generally upwardly extending main fuel well 64 which, as shown, may contain a main well tube 66 which, in turn, is provided with a plurality of generally radially directed apertures 68 formed through the wall thereof as to thereby provide for communication as between the interior of the tube 66 and the portion of the well 64 generally radially surrounding the tube 66. Conduit means 70 serves to communicate between the upper part of well 64 and the interior of discharge nozzle 60. Air bleed type passage means 72, comprising conduit means 74 and calibrated restriction or metering means 76, communicates as between a source of filtered air and the upper part of the interior of well tube 66. A main calibrated fuel metering restriction 78 is situated generally upstream of well 64, as for example in conduit means 62, in order to meter the rate of fuel flow from chamber 58 to main well 64. As is generally well known in the art, the interior of fuel reservoir chamber 58 is preferably pressure vented to a source of generally ambient air as by means of, for example, vent-like passage means 80 leading from chamber 58 to the inlet end 36 of induction passage 34.

Generally, when the engine is running, the intake stroke of each power piston causes air flow through the induction passage 34 and venturi throat 48. The air thusly flowing through the venturi throat 48 creates a low pressure commonly referred to as a venturi vacuum. The magnitude of such venturi vacuum is determined primarily by the velocity of the air flowing through the venturi and, of course, such velocity is determined by the speed and power output of the engine. The difference between the pressure in the venturi and the air pressure within fuel reservoir chamber 58 causes fuel to flow from fuel chamber 58 through the main metering system. That is, the fuel flows through metering restriction 78, conduit means 62, up through well 64 and, after mixing with the air supplied by the main well air bleed means 72, passes through conduit means 70 and discharges from nozzle 50 into induction passage means 34. Generally, the calibration of the various controlling elements are such as to cause such main metered fuel flow to start to occur at some predetermined differential between fuel reservoir and venturi pressure. Such a differential may exist, for example, at a vehicular speed of 30 m.p.h. at normal road load.

Engine and vehicle operation at conditions less than that required to initiate operation of the main metering system are achieved by operation of the idle fuel metering system, which may not only supply metered fuel flow during curb idle engine operation but also at off idle operation.

At curb idle and other relatively low speeds of engine operation, the engine does not cause a sufficient air flow through the venturi section 48 as to result in a venturi vacuum therein of sufficient magnitude to operate the main metering system. Because of the relatively almost closed throttle valve means 52, which greatly restricts air flow into the intake manifold 26 at idle and low engine speeds, engine or intake manifold vacuum is of a relatively high magnitude. This high manifold vacuum serves to provide a pressure differential which operates the idle fuel metering system.

Generally, the idle fuel system is illustrated as comprising calibrated idle fuel restriction metering means 82 communicating as between the fuel 60, within fuel reservoir or chamber 58, and a generally upwardly extending passage or conduit 84 which, at its upper end, is in communication with a second generally vertically extending conduit 86 the lower end of which communicates with a generally laterally extending conduit 88. A downwardly depending conduit 90 communicates at its upper end with conduit 88 while, at its lower end, it communicates with induction passage means 34 as through aperture means 12. As generally shown and as generally known in the art, passage 88 may terminate in a relatively vertically elongated discharge opening or aperture 96 located as to be generally juxtaposed to an edge of throttle valve 52 when such throttle valve 52 is in its curb-idle or nominally closed position. Often, aperture 96 is referred to in the art as being a transfer slot effectively increasing the area for flow of fuel to the underside of throttle valve 52 as the throttle valve is moved toward a more fully opened position.

Conduit means 98, provided with calibrated air metering or restriction means 100, serves to communicate as between an upper portion of conduit 86 and a source of atmospheric air as at the inlet end 36 of induction passage 34.

At idle engine operation, the greatly reduced pressure area below the throttle valve means causes fuel to flow from the fuel reservoir 58 through restriction means 82 and upwardly through conduit means 84 where, generally at the upper portion thereof, the fuel intermixes with the bleed air provided by conduit 98 and air bleed restriction means 100. The fuel-air emulsion then is drawn downwardly through conduit 86 and through conduits 88 and 90 ultimately discharged, posterior to throttle valve 52, through the effective opening of aperture 92.

During off-idle operation, the throttle valve means 52 is moved in the opening direction causing the juxtaposed edge of the throttle valve to further effectively open and expose a greater portion of the transfer slot or port means 96 to the manifold vacuum existing posterior to the throttle valve. This, of course, causes additional metered idle fuel flow through the transfer port means 96. As the throttle valve means 52 is opened still wider and the engine speed increases, the velocity of air flow through the induction passage 34 increases to the point where the resulting developed venturi vacuum is sufficient to cause the hereinbefore described main metering system to be brought into operation.

The structure as herein disclosed and described provides means, in addition to those hereinbefore described, for controlling and/or modifying the metering characteristics otherwise established by the fluid circuit constants previously described. In the embodiment thus far disclosed, among other cooperating elements, valving assemblies 102 and 104 are provided to enable the performance of such modifying and/or control functions.

Valving assembly 102 is illustrated as comprising variable but distinct chambers 106 and 108 effectively separated as by a pressure responsive wall or diaphragm member 110 which, in turn, has a valving member 112 operatively secured thereto for movement therewith. The valving surface 114 of valving member 112 cooperates with a calibrated aperture 116 of a member 118 as to thereby variably determine the effective cross-sectional flow area of said aperture 116 and therefore the degree to which communication between the upper portion of conduit 86 and chamber 108 is permitted. Resiliant means, as in the form of a compression spring 120 situated generally in chamber 106, serves to continually bias and urge diaphragm member 110 and valving member 112 toward a fully closed position against coacting aperture 116. As shown, chamber 108 is placed in communication with ambient atmosphere preferably through associated calibrated restriction or passage means 122 and via conduit means 98. Without at this time considering the overall operation, it should be apparent that for any selected differential between the manifold vacuum, $P_m$, and the pressure, $P_a$, within reservoir 58, the "richness" of the fuel delivered by the idle fuel metering system can be modulated merely by the moving of valving member 112 toward and/or away from coacting aperture means 116. That is, for any such given pressure differential, the greater the effective opening of aperture means 116 becomes the more air is bled into the idle fuel passing from conduit 84 into conduit 86. Therefore, because of such proportionately greater rate of idle bleed air, the less, proportionately, is the rate of metered idle fuel flow, thereby causing a reduction in the richness (in terms of fuel) in the fuel-air mixture supplied through the induction passage 34 and into the intake manifold 26. The converse is also true; that is, as aperture means 116 is more nearly totally closed, the total rate of flow of idle bleed air becomes increasingly more dependent upon the comparatively reduced effective flow area of restriction means 100 thereby proportionately reducing the rate of idle bleed air and increasing, proportionately, the rate of metered idle fuel flow. Accordingly, there is an accompanying increase in the richness (in terms of fuel) in the fuel-air mixture supplied through induction passage 34 and into the intake manifold 26.

Valving assembly 104 is illustrated as comprising upper and lower variable and distinct chamber 124 and 126 separated as by a pressure responsive wall or diaphragm member 128 to which is secured one end of valve stem 130 as to thereby move in response to and in accordance with the movement of wall or diaphragm means 128. The structure 129 defining the lower portion of chamber 126 serves to provide guide surface means for guiding the vertical movement of valve stem 130; chamber 126 is vented to atmospheric pressure, $P_a$, as by vent or aperture means 132 formed as through structure 129.

A first compression spring 134 situated generally within chamber 124 continually urges valve stem 130 in a downward direction as does a second spring 136 which is carried generally about stem 130 and axially contained as between structure 129 and a movable spring abutment 138 carried by stem 130.

An extension of stem 130 carries a valve member 140 with a valve surface 142, formed thereon, adapted to cooperate with a valving orifice 144 communicating generally between chamber 58 and a chamber-like area 146 which, in turn, communicates as via calibrated metering or restriction means 148 and conduit means 150 with a portion of the main metering system downstream of the main metering restriction means 78. As illustrated, such communication may be at a suitable point within the main well 64. Additional spring means 147 which may be situated generally in the chamber-like area 146, serve to continually urge valve member 142 and stem 130 upwardly.

Without at this time considering the overall operation of the structure of FIG. 2, it should be apparent that for any selected metering pressure differential between the venturi vacuum, $P_v$, and the pressure, $P_a$, within reservoir 58, the "richness" of the fuel delivered by the main fuel metering system can be modulated merely by the moving of valving member 140 toward and/or away from coacting aperture means 144. That is, for any such given metering pressure differential, the greater the effective opening of aperture means 144 becomes, the greater also becomes the rate of metered fuel flow since one of the factors controlling such rate is the effective area of the metering orifice means. With the opening of orifice means 144 it can be seen that the then effective metering area of orifice means 144 is, generally, additive to the effective metering area of orifice means 78. Therefore, a comparatively increased rate of metered fuel flow is consequently discharged, through nozzle 50, into the induction passage means 34. The converse is also true; that is, as aperture means 144 is more nearly or totally closed, the total effective main fuel metering area decreases and approaches that effective metering area determined by metering means 78. Consequently, the total rate of metered main fuel flow decreases and a comparatively decreased rate of metered fuel flow is discharged through nozzle 50, into the induction passage 34.

As shown, chamber 106 and 124 are each in communication with conduit means 152, as via conduit means 154 and 156, respectively.

As illustrated in FIG. 1, conduit means 152 is placed in communication with associated conduit means 158 effective for conveying a fluid control pressure to said conduit 152 and chambers 106 and 124. For purposes of illustration, such control pressure will be considered as being sub-atmospheric and to that extent a control vacuum, $V_c$, the magnitude of which, of course, increases as the absolute value of the control pressure decreases.

FIG. 1 also illustrates suitable logic control means 160 which, as contemplated in the preferred mode of operation of the invention and as hereinafter more fully described, comprises may be electrical logic control means which may have suitable electrical signal conveying conductor means 162, 164, 166 and 168 leading thereto for applying electrical input signals, reflective of selected operating parameters, to the circuitry of logic means 160. It should, of course, be apparent that such input signals may convey the required information in terms of the magnitude of the signal as well as conveying information by the absence of the signal itself. Output electrical conductor means, as at 170, serves to convey the output electrical control signal from the logic means 160 to associated electrically operated control valve means 172. A suitable source of electrical potential 174 is shown as being electrically connected to logic means 160, while control valve means 172 may be electrically grounded, as at 176.

In the preferred embodiment, the various electrical conductor means 162, 164, 166 and 168 are respectively connected to parameter sensing and transducer signal producing means 178, 180 and 182. In the embodiment depicted, the means 178 comprises oxygen sensor means communicating with exhaust conduit means 22 at a point generally upstream of a catalytic converter 184. The transducer means 180 may comprise electrical switch means situated as to be actuated by cooperating lever means 186 fixedly carried, as by the throttle shaft 54, and swingably rotatable therewith into and out of operating engagement with switch means 181, in order to thereby provide a signal indicative of the throttle 52 having attained a preselected position.

The transducer 182 may comprise suitable temperature responsive means, such as, for example, thermocouple means, effective for engine temperature and creating an electrical signal in accordance therewith.

For sake of clarity certain of said transducer means are further illustrated in Figures hereinafter more fully described.

A vacuum reservoir or tank 188 is shown being operatively connected and in communication with control valve 172, as by conduit means 190, and with the interior of the intake manifold 26 (serving as a source of engine or manifold vacuum, $P_m$) as by conduit means 192.

Even though the invention is not so limited, it is nevertheless contemplated that the catalytic converter means 184 would preferably be of the "three-way" type of catalytic converter as hereinbefore described and as is generally well known in the art. Further, any of many presently available and suitable oxygen sensor assemblies may be employed. Also, although the invention is not so limited, control valve means 172 may comprise a 3-way solenoid valving assembly effective for opening and closing (or otherwise modulating) aperture means for causing a varying effective restrictive effect upon fluid flow through such aperture means and thereby vary the effective pressure magnitudes on opposite sides of such aperture means. By varying the electrical signal to such 3-way solenoid valving assembly, it then becomes possible to selectively vary the magnitude of at least one of the fluid pressures and employ such as a control pressure. Various forms of such control valve assemblies are well known in the art, and, since the specific construction thereof forms no part of the invention, any such suitable control valve assembly may be employed. Further, testing and experimentation with the use of a pulsating type control valve means 172 has shown remarkable and unexpected improvements. As is generally well known in the art, a pulsating type of control valve is one which, during operation, has it valving member in a constant state of oscillation toward and away from the cooperating metering orifice. The manner in which control over resulting fluid flow and/or pressure is achieved, may be, generally, by varying the frequency and/or amplitude of such oscillation and/or the relative length of time that such pulsating control valve is energized compared to the length of time that such control valve is de-energized during the over all operating cycle.

Figure 9:
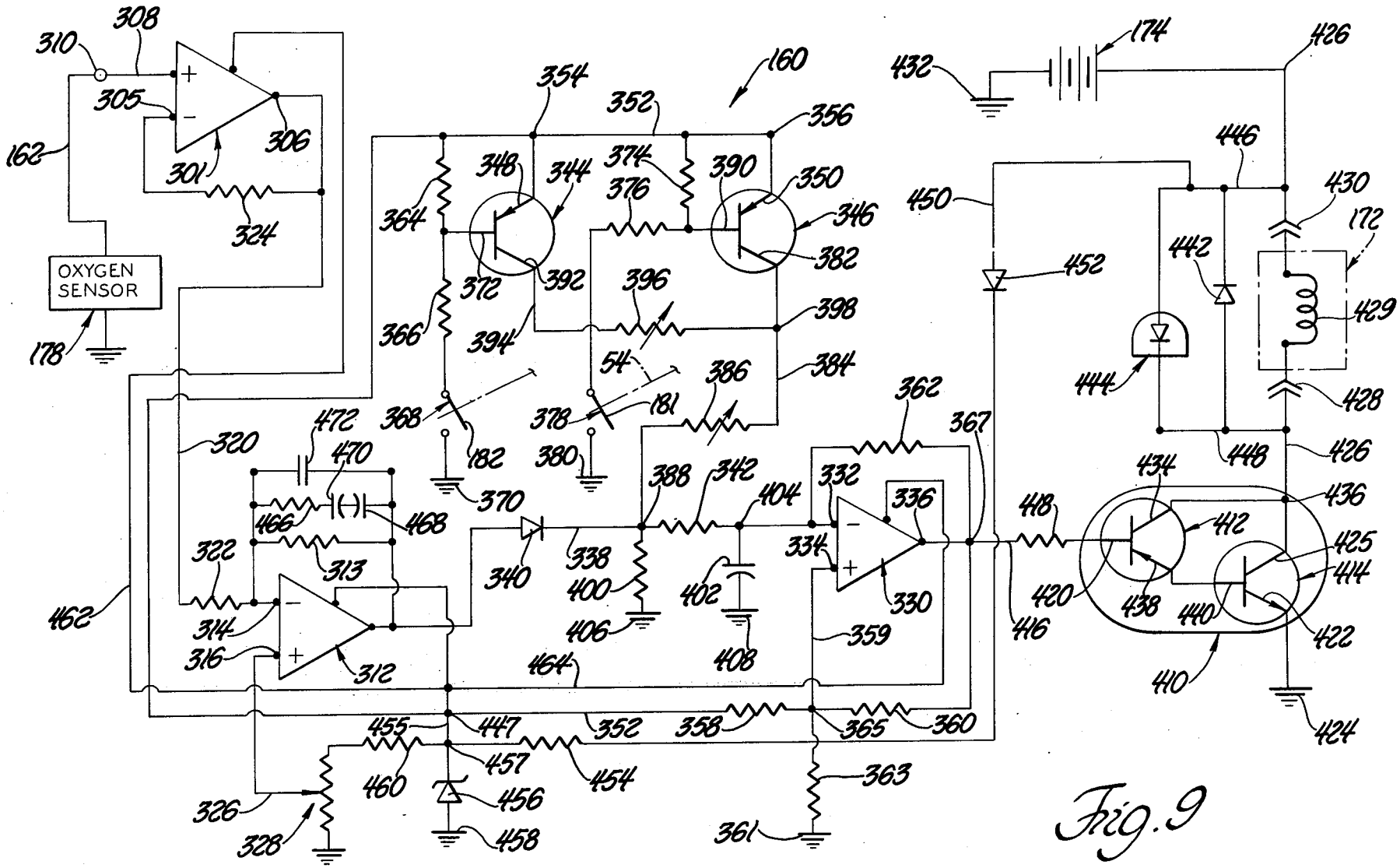
FIG. 9 is a schematic wiring diagram of one embodiment of logic and control circuit means embodying teachings of the invention.

Referring in greater detail to FIG. 9, one embodiment of the control and logic circuit means 160 is illustrated as comprising a first operational amplifier 301 having input terminals 303 and 305 along with output terminal means 306. Input terminal 303 is electrically connected as by conductor means 308 and a connecting terminal 310 as to output electrical conductor means 162 leading from the oxygen sensor 178. Although the invention is not so limited, it has, nevertheless, been discovered that excellent results are obtainable by employing an oxygen sensor assembly produced commercially by the Electronics Division of Robert Bosch GMBH of Schwieberdingen, Germany and as generally illustrated and described on pages 137–144 of the book entitled: "Automotive Electronics II" published February, 1975, by the Society of Automotive Engineers, Inc., 400 Commonwealth Drive, Warrendale, Pa., bearing U.S.A. copyright notice of 1975, and further identified as SAE (Society of Automotive Engineers, Inc.) Publication No. SP-393. Generally, such an oxygen sensor comprises a ceramic tube or cone of zirconium dioxide doped with selected metal oxides with the inner and outer surfaces of the tube or cone being coated with a layer of platinum. Suitable electrode means are carried by the ceramic tube or cone as to thereby result in a voltage thereacross in response to the degree of oxygen present in the exhaust gases flowing by the ceramic tube. Generally, as the presence of oxygen in the exhaust gases decreases, the voltage developed by the oxygen sensor decreases.

A second operational amplifier 312 has input terminals 314 and 316 along with output terminal means 318. Inverting input terminal 314 is electrically connected as by conductor means 320 and resistor means 322 to the output 306 of amplifier 301. Amplifier 301 has its inverting input 305 electrically connected via feedback circuit means, comprising resistor 324, electrically connected to the output 306 as by conductor means 320. The input terminal 316 of amplifier 312 is connected as by conductor means 326 to potentiometer means 328.

A third operational amplifier 330, provided with input terminals 332 and 334 along with output terminal means 336, has its inverting input terminal 332 electrically connected to the output 318 of amplifier 312 as by conductor means 338 and diode means 340 and resistance means 342 serially situated therein.

First and second transistor means 344 and 346 each have their respective emitter terminals 348 and 350 electrically connected, as at 354 and 356, to conductor means 352 leading to the conductor means 445 as at 447. A resistor 358, has one end connected to conductor 445 and its other resistor end connected to conductor 359 leading from input terminal 334 to ground 361 as through a resistor 363. Further, a resistor 360 has its opposite ends electrically connected as at points 365 and 367 to conductors 359 and 416. A feedback circuit comprising resistance means 362 is placed as to be electrically connected to the output and input terminals 336 and 332 of amplifier 330.

A voltage divider network comprising resistor means 364 and 366 has one electrical end connected to conductor means 352 as at a point between 354 and resistor 358. The other electrical end of the voltage divider is connected as to switch means 368 which, when closed, completes a circuit as to ground at 370. The base terminal 372 of transistor 344 is connected to the voltage divider as at a point between resistors 364 and 366.

A second voltage divider network comprising resistor means 374 and 376 has one electrical end connected to conductor means 352 as at a point between 354 and 356. The other electrical end of the voltage divider is connected as to second switch means 378 which, when closed, completes a circuit as to ground at 380. The base terminal 390 of transistor 346 is connected to the voltage divider as at a point between resistors 374 and 376. Collector electrode 382 of transistor 346 is electrically connected, as by conductor means 384 and serially situated resistor means 386 (which, as shown, may be a variable resistance means), to conductor means 338 as at a point 388 generally between diode 340 and resistor 342. Somewhat similarly, the collector electrode 392 of transistor 344 is electrically connected, as by conductor means 394 and serially situated resistor means 396 (which, as shown, may also be a variable resistance means), to conductor means 384 is at a point 398 generally between collector 382 and resistor 386.

As also shown, resistor and capacitor means 400 and 402 have their respective one electrical ends or sides connected to conductor means as at points 388 and 404 while their respective other electrical ends are connected to ground as at 406 and 408. Point 404 is, as shown, generally between input terminal 332 and resistor 342.

A Darlington circuit 410, comprising transistors 412 and 414, is electrically connected to the output 336 of operational amplifier 330 as by conductor means 416 and serially situated resistor means 418 being electrically connected to the base terminal 420 of transistor 412. The emitter electrode 422 of transistor 414 is connected to ground 424 while the collector 425 thereof is electrically connected as by conductor means 426 connectable, as at 428 and 430, to related solenoid-like valving means 172, and leading to the related source of electrical potential 174 grounded as at 432.

The collector 434 of transitor 412 is electrically connected to conductor means 426, as at point 436, while the emitter 438 thereof is electrically connected to the base terminal 440 of transistor 414.

Preferably, a diode 442 is placed in parallel with solenoid means 172 and a light-emitting-diode 444 is provided to visually indicate the condition of operation. Diodes 442 and 444 are electrically connected to conductor means 426 as by conductors 446 and 448.

Conductor means 450, connected to source 174 as by means of conductor 446 and comprising serially situated diode means 452 and resistance means 454, is connected to conductor means 455, as at 457, leading generally between amplifier 312 and one side of a zener diode 456 the other side of which is connected to ground as at 458. Additional resistance means 460 is situated in series as between potentiometer 328 and point 457 of conductor 455. Conductor 455 also serves as a power supply conductor to amplifier 312; similarly, conductors 462 and 464, each connected as to conductor means 455, serve as power supply conductors to operational amplifiers 301 and 330, respectively.

Figure 10:
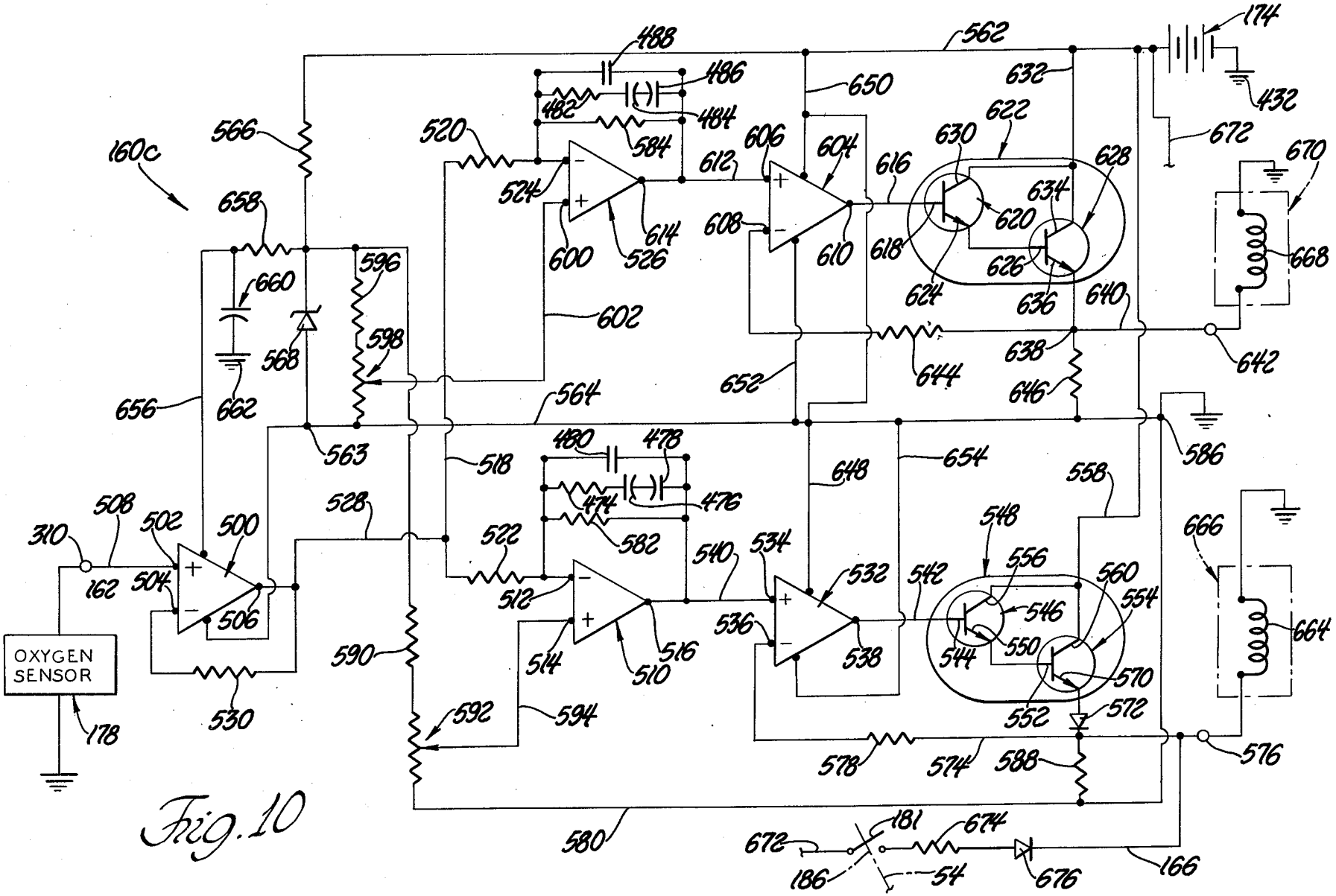
FIG. 10 is a schematic wiring diagram of a second embodiment of logic and control circuit means embodying teachings of the invention.

FIG. 10 illustrates another embodiment of control and logic circuit means 160*c* embodying teachings of the invention. Referring in greater detail to FIG. 10, the circuit means 160*c* is illustrated as comprising a first operational amplifier 500 having input terminals 502 and 504 along with output terminal means 506. Input terminal 502 is electrically connected as by conductor means 508 and connecting terminal 310 as to output electrical conductor means 162 leading from the oxygen sensor 178.

A second operational amplifier 510 has input terminals 512 and 514 along with output terminal means 516. Inverting input terminal 512 is electrically connected via conductor means 518 and series resistors 520 and 522 to an inverting input terminal 524 of a third operational amplifier 526 and further electrically connected to the output terminal 506 of amplifier 500 as by conductor means 528 connected to conductor means 518 as between resistors 520 and 522. A feedback circuit comprising resistance means 530 is situated as to be electrically connected across input and output terminals 504 and 506 of amplifier means 500.

Fourth operational amplifier 532 having input terminals 534 and 536 along with output terminal means 538 has its non-inverting input terminal 534 electrically connected as by conductor means 540 to the output 516 of amplifier 510. The output 538 of amplifier 532 is electrically connected via conductor means 542 to the base electrode 544 of a first transistor 546 comprising a first Darlington circuit 548. The emitter 550 of transistor 546 is connected to the base terminal 552 of the second transistor 554 of the Darlington circuit 548 while the collector 556 of transistor 546 is electrically connected to conductor means 558 leading as between collector 560 of transistor 554 and conductor means 562 leading to the source of electrical potential 174. As shown, conductor 562 is also connected at 563 to ground conductor means 564 as through serially situated resistor means 566 and zener diode means 568.

The emitter 570 of transistor 554 is electrically connected as through diode means 572 to conductor means 574 which, at one end is connected as to output terminal means 576 and, at its opposite end, through resistor means 578, to the inverting input terminal 536 of amplifier 532. Conductor means 580, comprising serially situated capacitor means 582 and resistor means 584 serves to interconnect output 506 of amplifier 500 to ground conductor 564 as at 586. A resistor 588 is situated as to be electrically across conductors 574 and 580.

A resistor 590 and potentiometer 592 are arranged in series and electrically connected across conductor means 562 and 580 with the non-inverting terminal 514 of amplifier 510 being electrically connected to potentiometer 592 via conductor means 594. Similarly, a resistor 596 and potentiometer 598 are arranged in series and electrically connected across conductor means 562 and 564 with a non-inverting input terminal 600 of amplifier 526 being electrically connected to potentiometer 598 via conductor means 602.

A fifth operational amplifier 604 having input terminals 606 and 608 along with output terminal means 610 has its non-inverting input terminal 606 electrically connected as by conductor means 612 to the output 614 of amplifier 526. The output 610 of amplifier 604 is electrically connected via conductor means 616 to the base electrode 618 of a first transistor 620 comprising a second Darlington circuit 622. The emitter 624 of transistor 620 is connected to the base terminal 626 of the second transistor 628 of the Darlington circuit 622 while the collector 630 of transistor 620 is electrically connected to conductor means 632 leading as between conductor means 562 and collector 634 of transistor 628. Emitter 636 of transistor 628 is electrically connected as at 638 to conductor means 640 which, at one end, is connected to output terminal means 642 and, at its other end through series resistor means 644 to input terminal 608 of amplifier 604. A resistor 646 is situated as to be electrically across conductor means 640 and 564. Suitable power supply and ground conductors may be provided for the various amplifiers as, for example, generally depicted at 648, 650, 652 and 654. A conductor 656, preferably with resistance means 658 serves as the power supply conductor to amplifier means 500. Preferably, capacitor means 660 has one electrical side connected to conductor means 656, as at a point generally between resistance means 658 and amplifier 500, and its other electrical side connected to ground as at 662.

As clearly shown, output terminal 576 is electrically connected to one electrical end of related winding means 664 of solenoid valving means 666 and, similarly, output terminal 642 is electrically connected to one electrical end of other related winding means 668 of associated solenoid valving means 670.

OPERATION OF INVENTION

Generally, the oxygen sensor 178 senses the oxygen content of the exhaust gases and in response thereto, produces an output voltage signal which is proportional or otherwise related thereto. The voltage signal is then applied, as via conductor means 162, to the electronic logic and control means 160 which, in turn, compares the sensor voltage signal to a bias or reference voltage which is indicative of the desired oxygen concentration. The resulting difference between the sensor voltage signal and the bias voltage is indicative of the actual error and an electrical error signal, reflective thereof, is employed to produce a related operating voltage which is applied to the control valve assembly 172 as by means of conductor 170.

Manifold or engine vacuum, generated during engine operaton, is conveyed to the vacuum reservoir means 188, which, via conduit means 190, conveys such vacuum to a conduit portion 194 of control valve assembly 172. The operation of control valve assembly 172 is such as to effectively variably bleed or vent a portion of the vacuum as to ambient atmosphere and thereby determine a resulting magnitude of a control vacuum which is applied to conduit means 158. The magnitude of such control vacuum, $V_c$, is, as previously generally described, determined by the electrical control signal and consequent operating voltage applied via conductor means 170 to control valve assembly 172, which, in the embodiment of the invention shown, comprises a solenoid-operated valve assembly.

As best seen in FIG. 2, the control vacuum, $V_c$, is applied via conduit means 152 to both pressure responsive motor means 102 and 104, and more specifically to respective chambers 106 and 124 thereof. Generally, as should be apparent, the greater the magnitude of $V_c$ (and therefore the lower its absolute pressure) the more upwardly are wall or diaphragm members 110 and 128 urged. The degree to which such members 110 and 128 are actually moved upwardly depends, of course, on the resilient resistance thereto provided by spring means 120, 134 and 136, as well as the upward resilient force of spring means 147 situated generally in chamber 146 and operatively engaging valve member 142.

Figure 3:
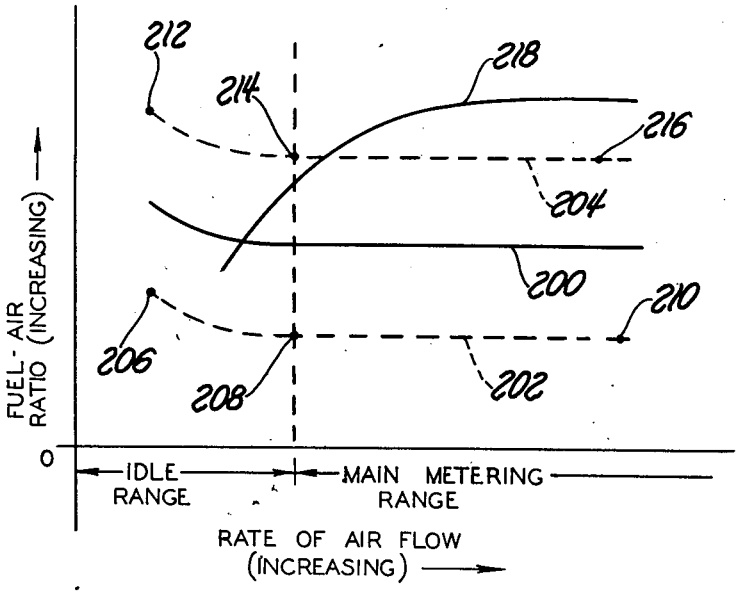
FIG. 3 is a graph illustrating, generally, fuel-air ratio curves obtainable with structures employing teachings of the invention.

The graph of FIG. 3 generally depicts fuel-air ratio curve obtainable by the invention. For purposes of illustration, let it be assumed that curve 200 represents a combustible mixture, metered as to have a ratio of 0.068 lbs. of fuel per pound of air. Then, as generally shown, the carbureting device of the invention could provide a flow of combustible mixtures in the range anywhere from a selected lower-most fuel-air ratio as depicted by curve 202 to an uppermost fuel-air ratio as depicted by curve 204. As should be apparent, the invention provides an infinite family of such fuel-air ratio curves between and including curves 202 and 204. This becomes especially evident when one considers that the portion of curve 202 generally between points 206 and 208 is achieved when valve member 112 of FIG. 2 is moved upwardly as to thereby open orifice 116 to its maximum intended effective opening and cause the introduction of a maximum amount of bleed air therethrough. Similarly, that portion of curve 202 generally between points 208 and 210 is achieved when valve member 142 is moved upwardly as to thereby close orifice 144 to its intended minimum effective opening (or totally effectively closed) and cause the flow of fuel therethrough to be terminated or reduced accordingly.

In comparison, that portion of curve 204 generally between points 212 and 214 is achieved when valve member 112 is moved downwardly as to thereby close orifice 116 to its intended minimum effective opening (or totally effectively closed) and cause the flow of bleed air therethrough to be terminated or reduced accordingly. Similarly, that portion of curve 204 generally between points 214 and 216 is achieved when valve member 142 is moved downwardly as to thereby open orifice 144 to its maximum intended opening and cause a corresponding maximum flow of fuel therethrough.

It should be apparent that the degree to which orifices 116 and 144 are respectively opened, during actual operation, depends on the magnitude of the control vacuum, $V_c$, which, in turn, depends on the control signal produced by the logic control means 160 and, of course, the control signal thusly produced by means 160 depends, basically on the input signal obtained from the oxygen sensor 178, as compared to the previously referred-to bias or reference signal. Accordingly, knowing what the desired composition of the exhaust gas from the engine should be, it then becomes possible to program the logic of means 160 as to create signals indicating deviations from such desired composition as to in accordance therewith modify the effective opening of orifices 116 and 144 to increase and/or decrease the richness (in terms of fuel) of the fuel-air mixture being metered to the engine. Such changes or modifications in fuel richness, of course, are, in turn, sensed by the oxygen sensor 178 which continues to further modify the fuel-air ratio of such metered mixture until the desired exhaust composition is attained. Accordingly, it is apparent that the system disclosed defines a closed-loop feedback system which continually operates to modify the fuel-air ratio of a metered combustible mixture assuring such mixture to be of a desired fuel-air ratio for the then existing operating parameters.

It is also contemplated, at least in certain circumstances, that the upper-most curve 204 may actually be, for the most part, effectively below a curve 218 which, in this instance, is employed to represent a hypothetical curve depicting the best fuel-air ratio of a combustible mixture for obtaining maximum power from engine 10, as during wide open throttle (WOT) operation. In such a contemplated contingency, the invention provides transducer means 180 (FIG. 1) adapted to be operatively engaged, as by lever means 186, when throttle valve 52 has been moved to WOT condition. At that time, the resulting signal from transducer means 180, as applied to means 160, causes logic means 160 to appropriately respond by further altering the effective opening of orifices 116 and 144. That is, if it is assumed that curve portion 214–216 is obtained when effectively opened to a degree less than its actual maximum physical opening, then further effective opening thereof may be accomplished by causing a further downward movement of valve member 140. During such phase of operation, the metering becomes an open loop function and the input signal to logic means 160 provided by oxygen sensor 178 is, in effect, ignored for so long as the WOT signal from transducer 180 exists.

Similarly, in certain engines, because of any of a number of factors, it may be desirable to assure a lean (in terms of fuel richness) base fuel-air ratio (enriched by the well known choke mechanism) immediately upon starting of a cold engine. Accordingly, the invention contemplates the use of engine temperature transducer means 182 which is effective for producing a signal, over a predetermined range of low engine temperatures, and applying such signal to logic control means 160 as to thereby cause such logic means 160 to, in turn, produce and apply a control signal, via 170, to control valve 172, the magnitude of which is such as to cause the resulting fuel-air ratio of the metered cumbustible mixture to be, for example, in accordance with curve 202 of FIG. 3 or some other selected relatively "lean" fuel-air ratio.

Further, it is contemplated that at certain operating conditions and with certain oxygen sensors, it may be desirable or even necessary to measure the temperature of the oxygen sensor itself. Accordingly, suitable temperature transducer means, as for example thermocouple means well known in the art, may be employed to sense the temperature of the operating portion of the oxygen sensor means 178 and to provide a signal in accordance or in response thereto via conductor means 164 to the electronic control means 160. That is, it is anticipated that it may be necessary to measure the temperature of the sensory portion of the oxygen sensor 178 to determine that such sensor 178 is sufficiently hot to provide a meaningful signal with respect to the composition of the exhaust gas. For example, upon re-starting a generally hot engine, the engine temperature and engine coolant temperatures could be normal (as sensed by transducer means 182) and yet the oxygen sensor 178 is still too cold and therefore not capable of providing a meaningful signal, of the exhaust gas composition, for several seconds after such re-start. Because a cold catalyst cannot clean up from a rich mixture, it is advantageous, during the time that sensor means 178 is thusly too cold, to provide a relatively "lean" fuel-air ratio mixture. The sensor means 178 temperature signal thusly provided along conductor means 164 serves to cause such logic means 160 to, in turn, produce and apply a control signal, via 170 to control valve 172, the magnitude of which is such as to cause the resulting fuel-air ratio of the metered combustible mixture to be, for example, in accordance with curve 202 of FIG. 3 or some other selected relatively "lean" fuel-air ratio.

Figure 4:
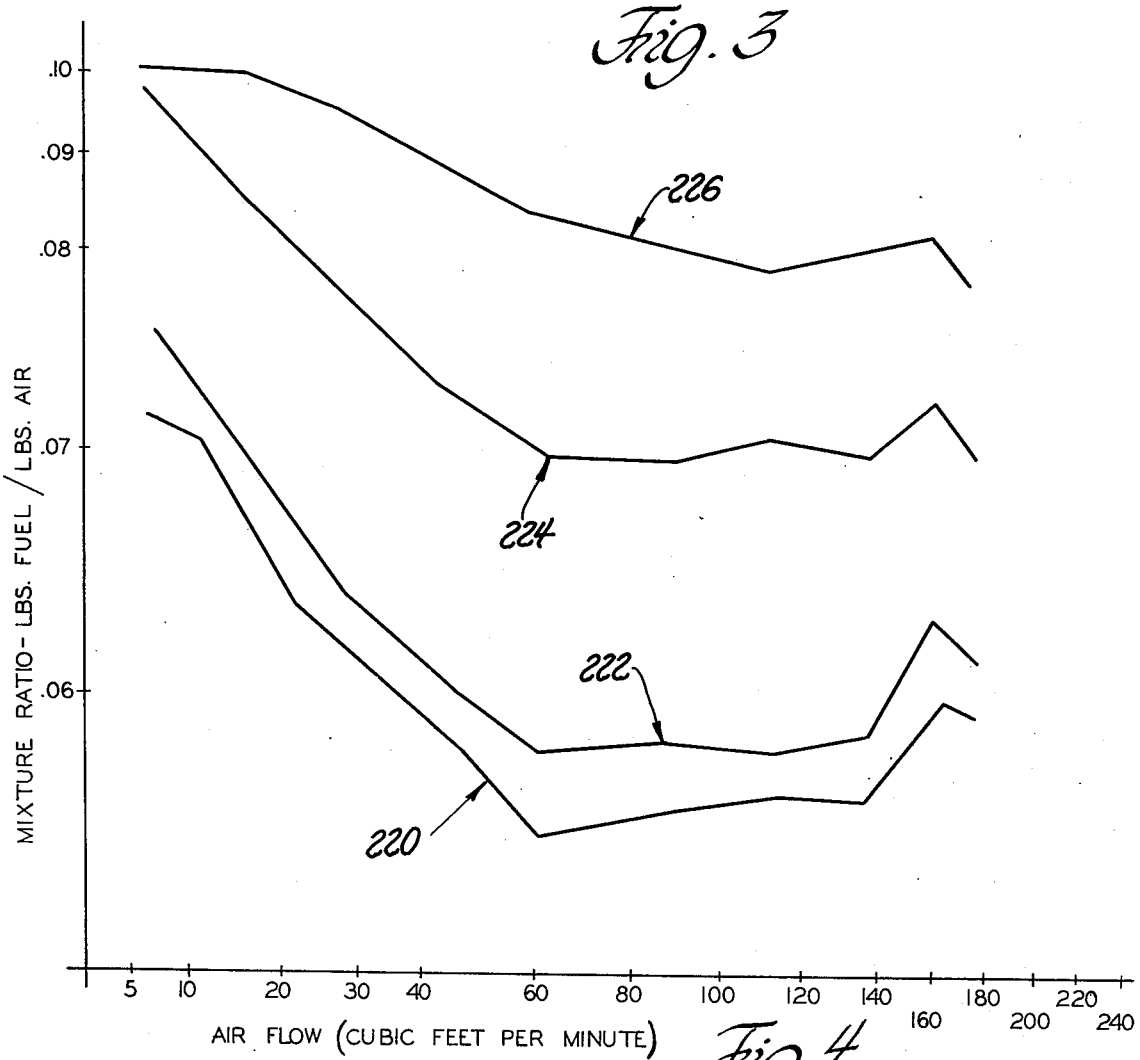
FIG. 4 is a graph depicting fuel-air ratio curves obtained from one particular tested embodiment employing teachings of the invention.

FIG. 4 illustrates fuel-air mixture curves, obtained during testing of one particular embodiment of the invention with such curves being obtained at varying values of control pressure, $P_c$, to the carburetor. That is, flow curve 220 was obtained at a control vacuum of 5.0 inches of $H_g$; flow curve 222 was obtained at 4.0 inches of $H_g$; flow curve 224 was obtained at 2.5 inches of $H_g$ while flow curve 226 was obtained at 1.0 inch of $H_g$. It should be noted that at the maximum applied vacuum (5.0 inches of $H_g$) flow curve 220 corresponds generally to a typical part throttle fuel delivery curve while the flow curve 226 at minimum vacuum (1.0 inch of $H_g$) corresponds generally to a typical best engine power or wide open throttle delivery curve. Accordingly, it can be seen that in the event of a total electronic or vacuum failure in the system disclosed, the associated vehicle remains drivable regardless of whether such failure results in maximum or minimum applied vacuum or anywhere in between.

Figure 5:
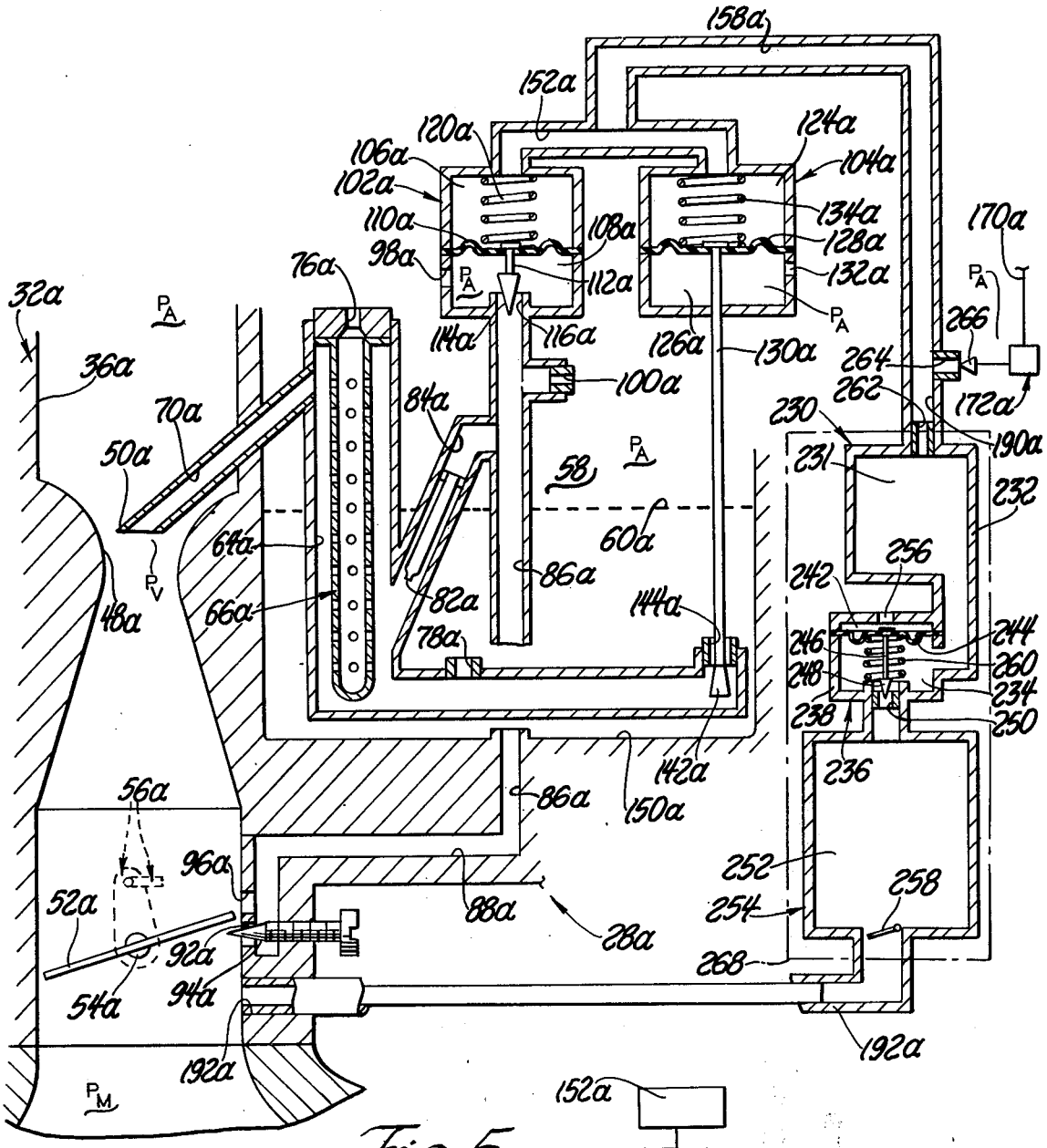
FIG. 5 is a generally cross-sectional view of another form of carbureting apparatus controlled in accordance with the teachings of the invention.

FIG. 5, in somewhat simplified and diagrammatic form, illustrates a further form of the invention. All elements in FIG. 5 which are like or similar to those of FIGS. 1 and 2 are identified with like reference numbers provided with a suffix "a".

Aside from other features to be described, the structure of FIG. 5 illustrates the use of a main metering restriction 78*a* and an idle tubular metering restriction 82*a* situated generally downstream of restriction 78*a*, as is well known in the art. In retrospect, it will be apparent that restriction means 78 and 82 of FIG. 2 may be functionally arranged in the same manner as restrictions 78*a* and 82*a*.

Further, passage means 158*a* is illustrated as communicating generally between passage means 152*a* and suitable pressure accumulator means 230 which, as by related conduit means 232, in turn communicates with a chamber 234 of a pressure regulator assembly 236.

The pressure regulator assembly 236 is illustrated as comprising housing means 238 having therein chamber means 234 and 242 effectively separated from each other as by movable pressure responsive wall or diaphragm means 244 to which is secured a stem portion 246 of a valve member 248 adapted to cooperate with a calibrated orifice passage 250 serving to provide communication as between chamber 234 and chamber 252 of second pressure accumulator means 254. Suitable check valve means, such as, for example, a flapper valve as generally indicated at 258 is preferably provided in cooperation with chamber 252 of accumulator 254 to establish unidirectional flow, as through cooperating conduit means 192*a* leading to a source of manifold vacuum, $P_m$.

As shown, chamber 234 of regulator 236 communicates with chamber 231 of accumulator 230 while chamber 242 is vented to atmosphere, as by passage or vent means 256. Suitable compression spring means 260 urges wall or diaphragm means 244 upwardly and simultaneously urges valve member 248 away from cooperating calibrated aperture or orifice means 250. Obviously, the smaller the effective flow area of orifice means 250 becomes, due to the increased closing thereof by valve member 248, the greater the pressure drop thereacross.

Preferably, calibrated restriction or passage means 262 is provided generally between passage 158*a* and chamber 231 to establish a desired rate of flow into chamber 231. Further, calibrated orifice or passage means 264 is provided generally upstream of calibrated passage 262 to communicate, generally, between the atmosphere and passage means 158*a*. Valving means, schematically illustrated at 172*a*, and comprising a variably positionable valve member 266, serves to variably but controllably determine the effective flow area of calibrated passage 264 in order to thereby vary the effective pressure, $V_c$, within passage 158*a* and chambers 106*a* and 124*a*. As previously explained with respect to valving means 172 of FIGS. 1 and 2, valving means 172*a* is actuated and controlled by the logic means 160 as via conductor means 170*a*. As previously stated, such valve means 172*a* may, in fact, comprise solenoid operated valving members.

As should be apparent, pressure regulator means, as at 236, may also be employed in the arrangement of FIG. 1 as by functionally placing such pressure regulator means in circuit with and between accumulator means 188 and control valve means 172. Generally, for all practical purposes, the combination and coaction of pressure accumulators 230, 254 and pressure regulator 236 provides a source 268 of generally constant subatmospheric pressure as far as conduit means 158*a* is concerned.

Figure 6:
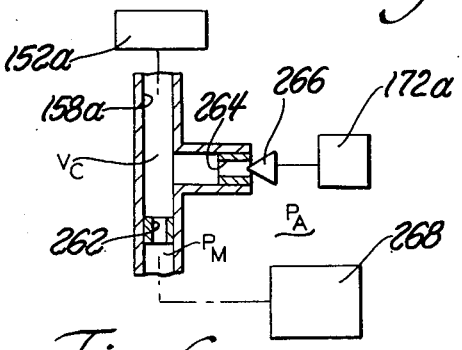
FIGS. 6 and 7 are each generally fragmentary and schematic illustrations of different arrangements for variably and controllably determining the magnitude of the actuating pressure differential employed as by structures generally typically depicted as by FIGS. 2 and 5.
Figure 7:
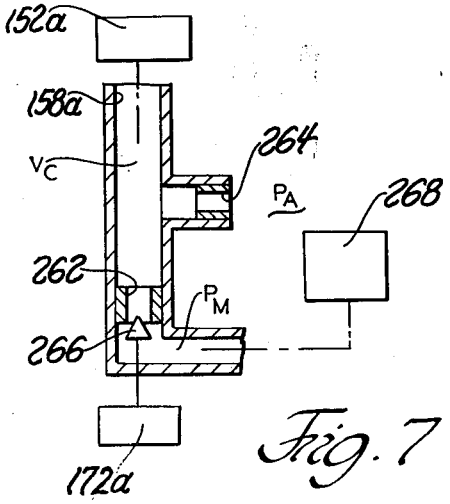

Various control valving means are contemplated. FIGS. 6 and 7 schematically illustrate two general arrangements of which FIG. 6 corresponds generally to the system of FIG. 5, wherein a valving member variably controls the degree of atmospheric air bleed permitted through suitable restriction means 264. FIG. 7 illustrates another general arrangement wherein the valving members 266 serves to variably control the degree of communication of the manifold or control vacuum with, for example, passage means 158*a*. Obviously, combinations of such systems as generally depicted by FIGS. 6 and 7 could also be employed.

Figure 8:
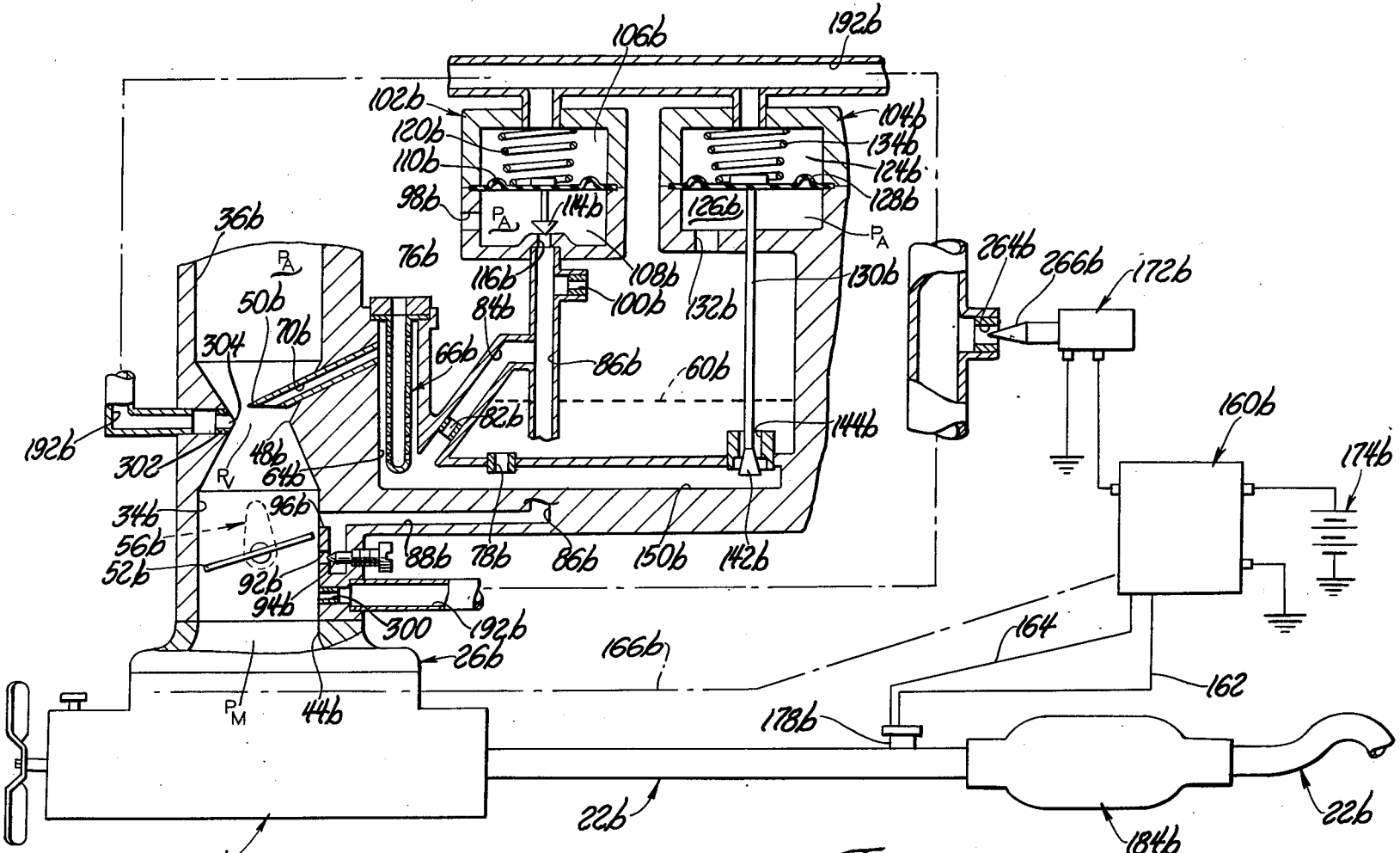
FIG. 8 is a generally cross-sectional view illustrating yet another aspect of the invention.

FIG. 8 illustrates yet another aspect of the invention. All elements in FIG. 8 which are like or similar to those of FIG. 1, 2 or 5 are identified with like reference numbers provided with a suffix "b".

Among other possible arrangements, the invention as shown in FIG. 8 contemplates the provision of suitable calibrated restriction passage means 300 in the passage means 192b leading to a source of engine or manifold vacuum as at a point in the carburetor structure generally downstream of the throttle valve 52b. Conduit or passage means 192b is shown having a sized or calibrated atmospheric bleed orifice 264b the effective area of which is variably controlled as by a valve 266b of a proportional solenoid valve assembly 172b which, in turn, is controlled by the electrical logic and actuating means 106b. Branch conduit or passage means 192b leads to respective chambers 106b and 124b of motor means 102b and 104b. The other end of passage means 192b is operatively connected as to the induction passage 34b as at a point 304 to sense the venturi vacuum, $P_v$, and communicate such venturi vacuum to chambers, 106b and 124b.

In the main, the use of venturi vacuum sensing means, as at 304, and manifold vacuum sensing means, as at 300, results in an overall available vacuum supply during all conditions of engine operation. That is, during relatively low engine speeds and engine loads the magnitude of the manifold vacuum, $P_m$, is relatively high while the magnitude of the venturi vacuum, $P_v$, is relatively low. However, during higher engine speeds and, for example, wide open throttle operation (WOT) the magnitude of the manifold vacuum becomes minimal while the magnitude of the venturi vacuum becomes relatively high. Therefore, it becomes possible, especially with selected values of flow restriction provided by restrictions 300 and 302, to employ sources of both manifold and venturi vacuum to provide the overall necessary pressure differential to achieve movement of valves 114b and 144b as dictated by the logic means 172b.

It is of course apparent, in view of the disclosure herein made, that the various vacuum passage means and chambers 106 (or 106a or 106b) and 124 (or 124a or 124b) may be formed as to comprise an overall carburetor structure. Also, it is contemplated that single motor means functioning equivalently to motor means 102 and 104 could be employed for the actuation of the related valve members 114 and 144.

Further, it is also contemplated that instead of the pressure responsive motor means, such as 102 and 104, means such as electro-mechanical transducer, of which a proportional solenoid is one form may be employed for directly controlling associated valve members 114 and 144. In such event, there would be no need for creating a pressure differential for actuation of such valve members 114 and 144. Instead, the logic means 160 could directly control the operation of the proportional solenoids.

Referring now in greater detail to FIG. 9, the oxygen sensor 178 produces a voltage input signal along conductor means 162, terminal 310 and conductor means 308 to the input terminal 303 of operational amplifier 301. Such input signal is a voltage signal indicative of the degree of oxygen present in the exhaust gases and sensed by the sensor 178.

Amplifier 301 is employed as a buffer and preferably has a very high input impedance. The output voltage at output 306 of amplifier 301 is the same magnitude, relative to ground, as the output voltage of the oxygen sensor 178. Accordingly, the output at terminal 306 follows the output of the oxygen sensor 178.

The output of amplifier 301 is applied via conductor means 320 and resistance 322 to the inverting input terminal 314 of amplifier 312. Feedback resistor 313 causes amplifier 312 to have a preselected gain so that the resulting amplified output at terminal 318 is applied via conductor means 338 to the inverting input 332 of amplifier 330. Generally, at this time it can be seen that if the signal on input 314 goes positive (+) then the output at terminal 318 will go negative (−) and if the input at terminal 332 of amplifier 330 goes negative (−) then the output at 336 of amplifier 330 will go positive (+).

The input 316 of amplifier 312 is connected as to the wiper of potentiometer 328 in order to selectively establish a set-point or a reference point bias for the system which will then represent the desired or reference value of fuel-air mixture and to then be able to sense deviations therefrom by the value of the signal generated by sensor 178.

Switch means 368, which may comprise the transducer switching (or equivalent structure) means 182, when closed, as when the engine is below some preselected temperature, causes transistor 344 to go into conduction thereby establishing a current flow through the emitter 348 and collector 392 thereof and through resistor means 396, point 398, resistor means 386 to point 388 and through resistor 400 to ground 406. The same happens when, for example, switch means 378, which may comprise the throttle operated switch 181, is closed during WOT operation. During such WOT conditions (or ranges of throttle opening movement) it is transistor 346 which becomes conductive. In any event, both transistors 344 and 346, when conductive, cause current flow into resistor 400.

An oscillator circuit comprises resistor 342, amplifier 330 and capacitor 402. When voltage is applied as to the left end of resistor 342, current will flow through such resistor 342 and tend to charge up capacitor 402. If it is assumed, for purposes of discussion, that the potential of the non-inverting input 334 is for some reason lower than that of the inverting input 332, the output of the operational amplifier at 336 will be relatively high and near or equal to the supply voltage of all of the operational amplifiers as derived from the zener diode 456. Consequently, current will flow as from point 367 through resistor 360 to point 365 and conductor 359, leading to the non-inverting input 334 of amplifier 330, and through resistor 363 to ground at 361. Therefore, it can be seen that when amplifier 330 is in conduction, there is a current component through resistor 360 tending to increase the voltage drop across resistor 363.

As current flows from resistor 342, capacitor 402 undergoes charging and such charging continues until its potential is the same as that of the non-inverting input 334 of amplifier 330. When such potential is attained, the magnitude of the output at 336 of operational amplifier 330 will become relatively low because the voltage at the inverting output is relatively high. At this time the output of amplifier is placed at a substantially ground potential and effectively places resistor 360 to ground. Therefore, the magnitude of the voltage at the non-inverting input terminal 334 suddenly drops and the inverting input 332 suddenly becomes at a higher potential than the non-inverting input 334. At the same time, resistor 342 is also effectively to ground thereby tending to discharge the capacitor 402.

The capacitor 402 will then discharge thereby decreasing in potential and approaching the now reduced potential of the non-inverting input 334. When the potential of capacitor 402 equals the potential of the non-inverting input 334, then the output 336 of amplifier 330 will suddenly go to its relatively high state again and the potential of the non-inverting input 334 suddenly becomes at a much higher potential than the discharged capacitor 402.

The preceding oscillating process keeps repeating.

The discharge time of the capacitor 402 is equal to the time constant of the capacitor 402 and the resistor 342. The charging time of capacitor 402 is dependent upon the magnitude of the input voltage. That is, the higher the voltage the faster the capacitor is going to charge. Therefore, the higher the output voltage the shorter will be the "off" time of amplifier 330. Since the discharge time of the capacitor 402 is constant, then the ratio of the "on" time to the "off" time becomes a function of the voltage applied by the oxygen sensor 178 through amplifiers 301 and 312 to point 388 and resistor 342.

The consequent signal generated by the turning "on" and turning "off" of amplifier 330 is applied to the base circuit of the Darlington circuit 410. When the output of amplifier 330 is "on" or as previously stated relatively high, the Darlington 410 is made conductive thereby energizing winding 429 of the solenoid valve assembly 172. Diode 442 is provided to suppress high voltage transients as may be generated by winding 429 while the LED may be employed, if desired, to provide visual indication of the operation of the winding 429.

As should be evident, the ratio of the "on" or high output time of amplifier 330 to the "off" or low output time of amplifier 330 determines the relative percentage or portion of the cycle time at which coil 429 is energized thereby directly determining the effective orifice opening controlled by the valve member positioned by the energization of coil 429.

Assuming now, for purposes of description, that the output of oxygen sensor 178 has gone positive (+) or increased meaning that the fuel-air mixture has become enrichened (in terms of fuel). Such increased voltage signal is applied to input 314 of amplifier 312 and the output 318 of amplifier 312 drops in voltage because of the inverting of input 314. Because of this less voltage is applied to the resistor 342 and therefore it takes longer to charge up capacitor 402. Consequently, the ratio of the "on" or high output time to the "off" or low output time of amplifier 330 decreases. This ultimately results in applying less average current to the coil 429 which, in turn, means more vacuum being applied to the vacuum motors 102 and 104 of FIG. 2.

It should now also become apparent that with either or both switch means 368 or 378 being closed a greater voltage is applied to resistor 342 thereby reducing the charging time of the capacitor 402 with the result, as previously described, of altering the ratio of the "on" time to "off" time of amplifier 330.

As can be seen, in addition to feedback resistor 313, a series arranged resistor 466 and capacitor means 468 and 470 are placed in parallel with resistor 313 as is additional capacitor means 472.

Often in piston engines having multi-cylinders, the degree of ignition and burning of the fuel-air mixture varies as among such cylinders due to many factors such as, for example, the design of the engine intake manifold, engine load and effectiveness of the respective ignition spark plugs. The sensitivity of oxygen sensor means as 178 is often so great that the sensor actually senses and reacts to the variations in engine exhaust gas content resulting from such variations in the degree of burning of the fuel-air mixtures. In thusly reacting, the oxygen sensor will actually produce pulsating-like variations, in possibly spike form, in the signal applied to the amplifier 301 the output of which, as previously stated, follows the sensor 178. Capacitor 472 is effective to filter out any such pulsations and in effect provides for gain reduction and lag to changes in the magnitude of the output signal produced by the oxygen sensor 178. Capacitor means 470 and 468 along with resistance means 466 are employed to provide a lag function and reduce the dynamic gain of the amplifier 312 as to result in the complete closed loop metering system being stable and free of oscillations. Accordingly, it can be seen that amplifier means 312 and associated circuitry provides a gain function as well as a lag and attenuation function.

Figure 11:
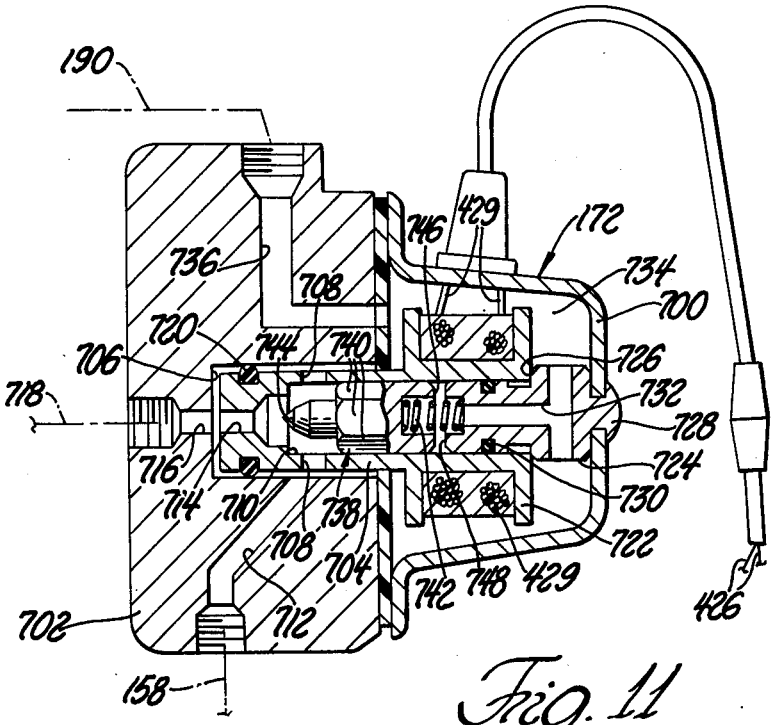
FIG. 11 is a cross-sectional view of one embodiment of valving means employable in the practice of the invention.

One embodiment of a vacuum control valve assembly 172 is illustrated in FIG. 11 and is shown as comprising a bell-like housing 700 suitably sealingly secured to and carried by a cooperating housing section 702. A valve housing 704 is partly closely received by and retained within a cooperating recess or chamber 706. Valve housing 704 has a plurality of radially directed ports 708 which communicate as between an inner chamber or passage 710 formed in valve housing 704 and passage means 712 leading to vacuum motor conduit 158. Further, axially extending passage means 714 formed in valve housing 704 serves to communicate as between inner chamber 710 and one end 716 of a conduit 718 leading as to ambient atmosphere. A suitable, for example, O-ring seal 720 is preferably provided as to preclude any undesirable communication as between conduit 718 and ports 708 and/or passage 712.

The other end of valve housing 704 may be provided with a bobbin like portion 722 for effectively carrying the solenoid winding 429 which has its leads 426—426 connectable as generally shown in FIG. 9. A generally cylindrical mounting-like body portion 724 is closely centrally received within bobbin portion 722 and effectively abuts against bobbin 722 as by an annular shoulder 726. The outer end 728 is preferably fixedly secured to bell housing 700. A suitable, for example, O-ring seal 730 is preferably provided about member 724. Passage means 732 formed in member 724 serves to complete communication as between chamber 734, generally within bell housing 700, and inner chamber 710 of valve housing 704. A conduit 736 communicates between chamber 734 and conduit 190 leading to a source of vacuum.

The armature of the solenoid valve assembly comprises a valve member 738 having a valve body with generally axially extending flatted portions 740 which respectively provide for clearance space as between such flatted portions and the juxtaposed surface of inner passage or chamber 710. A compression spring 742 serves to continually urge valve member 738 to the left as to have the valving end 744 thereof sealingly seat against conduit 714.

Generally, as can be seen, ambient atmospheric air is admitted via conduit 718 through end 716 to passage 714 while vacuum is communicated via conduits 190 and 736 to chamber 734 and conduit 732 to the inner chamber 710.

When current is applied to coil 429 a magnetic field is generated which, in turn, pulls armature-valve member 738 to the right until its ends 746 abuts and seals against juxtaposed end 748 of body 724 which serves to seal and prevent communication of vacuum from chamber 734 to inner chamber 710. Simultaneously, with valve 738 in its right-most position, free communication is completed as between conduit end 716 and conduit means 712 and 158.

Modulation between valve 738 positions of full "on" (valve member 738 being in its right-most position) and full "off" (valve member 738 being in its left-most position) results from varying the percentage of on-time of the current to solenoid winding 429 as already described with reference to FIG. 9. This results in an average valve opening that is generally related to the percentage of such on-time current flow which, in turn, is reflective of the signal generated by the oxygen sensor 178.

Referring now in greater detail to FIG. 10, the oxygen sensor 178 produces a voltage input signal along conductor means 162, terminal 310 and conductor means 508 to the input terminal 502 of operational amplifier 500. Such input signal is a voltage signal indicative of the degree of oxygen present in the exhaust gases and sensed by the sensor 178.

Amplifier 500 is employed as a buffer and has a very high input impedence which prevents any loading effects taking place on the oxygen sensor. The output voltage at output 506 of amplifier 500 is the same magnitude, relative to ground, as the output voltage of the oxygen sensor 178. Accordingly, the output at terminal 506 follows the output of the oxygen sensor 178.

The output of amplifier 500 is applied via conductor means 528 to conductor means 518 and, through resistors 520 and 522, to the respective inverting input terminals 524 and 512 of amplifiers 526 and 510. Feedback resistor 582 causes the amplifier 526 to have a preselected gain so that the amplified output at terminal 614 is applied via conductor means 512 to the non-inverting input 606 of amplifier 604. Generally, at this time it can be seen that if the signal on input 524 of amplifier 526 goes positive (+) then the output signal at 614 of amplifier 526 will go negative (−) and if the signal to input 606 of amplifier 604 goes negative (−) then the output at 610 of amplifier 604 will also go negative (−). Therefore, generally, as the fuel-air mixture delivered to the engine becomes richer (in terms of fuel) the oxygen sensor signal voltage tends to increase in magnitude and the output of amplifier 526 tends to decrease or go lower and the output of amplifier 604 tends to decrease or go lower.

Generally, in the invention, as the current through solenoid or valve winding 668 is reduced, as will become even more evident as the description progresses, then the associated valving means causes a reduction in the richness of the fuel being metered by idle system.

Now, assuming that the signal voltage from the oxygen sensor 178 has decreased, indicating a reduction in the oxygen content sensed in the exhaust gases, which, in turn, means that the input voltage to input 606 of amplifier 604 has increased, this being due to the inverting function of amplifier 526. For purposes of discussion, let it be assumed that the output of amplifier 526 has thusly increased 1.0 volt. Accordingly, the output at terminal 610 of amplifier 604 would also be increased by 1.0 volt and such increase in amplifier 604 output voltage will also increase the voltage to the emitter-base diode of transistor 620 in the Darlington circuit 622 thereby increasing the current flowing through collector 630 and emitter 624 thereby causing the second transistor 628 to become more conductive as to thereby increase the current flowing through the collector 634 and emitter 636 and through the winding 668 of the linear motor means 670.

As the current flow through the winding 668 increases there is an accompanying increase in the voltage drop thereacross. A characteristic of an operational amplifier is that the inverting and non-inverting inputs are always going to be of substantially equal magnitudes of voltage. Therefore, as the current flow increases through winding 668 of linear motor assembly 670 the voltage at emitter 636, as a point 638, is fed back, through resistor 644 to the inverting input terminal 608 of amplifier 604 and thereby restricts the increase in voltage from the output 610 of amplifier 604 to only that which is necessary to achieve an increase of 1.0 volt across the solenoid winding 668. This is a continuous action experienced by the amplifier 604, Darlington 622 and coil or winding 668. That is, for example, if the input voltage at input 606 increases 1.0 volt, the magnitude of the voltage at the inverting input 608 will also increase 1.0 volt because of the inherent characteristic of the amplifier means 604. The only way that terminal 608 is able to thusly follow the change in magnitude of voltage at input 606 is by increasing the current flowing through winding 668 and such is done by forcing the transistor 628 to supply more emitter current to the solenoid winding 668 and force its voltage to increase.

With reference to amplifier 526, it can be seen that the non-inverting input terminal 600 is connected through conductor means 602 to the voltage divider 596, 598 across zener diode 568. This enables an adjustably selectable bias as to establish a desired energization of the solenoid winding 668, and therefore a desired position of the related valving member positioned by such winding 668, in response to a given output of the oxygen sensor 178.

For example, let it be assumed that the wiper on the potentiometer was adjusted as to produce 0.5 volt thereby causing input terminal 600 to also be at 0.5 volt. If at this time the output of the oxygen sensor 178 happens to be 0.5 volt then the output of buffer amplifier will also be 0.5 volt and such will appear on conductor 518 and at the left-end (as viewed in FIG. 10) of resistor 520. Since, as previously mentioned, the inputs of operational amplifiers are always at substantially equal voltage, and since input terminal 600 is at 0.5 volt, then input terminal 524 will also be at 0.5 volt and there will be no current flowing through resistor 520. With input termimals 600 and 524 each being at 0.5 volt, the output 614 of amplifier 526 will be at 0.5 volt and such will be applied to input 606 of amplifier 604 causing, as previously described, input 608 of amplifier 604 to be set at 0.5 volt and the Darlington 622 to provide sufficient current flow through solenoid winding 668 as to produce 0.5 volt across such winding.

If from the above assumed condition, it is further assumed that the oxygen sensor 178 decreases to, for example, 0.4 volt current can flow through resistance means 520 and, if an amplification of ten is assumed across amplifier 526, amplifier 526 will have an output increase of 1.0 volt to a value of 1.5 volts and, in the manner previously described, current through the solenoid winding will increase until there is a total of 1.5 volts drop across such winding 668. Generally, as previously described, a reduction in the magnitude of the output signal from oxygen sensor 178 indicates a "leaning-out" of the fuel-air mixture (in terms of fuel) and if the same 0.5 volt setting selectively established at potentiometer 598 is considered to be the set-point or reference-point of the system, then it can be seen that as the fuel-air mixture apparently started to become too "lean" winding 668 was more fully energized as to thereby move associated valve member 114*c* (FIG. 12) more nearly closed against cooperating orifice 116*c* to thereby enrichen (in terms of fuel) the fuel-air mixture being metered and supplied to the engine.

As is evident from an inspection of FIG. 10, amplifier 510 functions in the same manner as amplifier 526, amplifier 532 functions in the same manner as amplifier 604, and Darlington 548 functions in the same manner as Darlington 622. Potentiometer 592 functionally corresponds to potentiometer 598 counterpart in resistor 588 with each thereof functioning to absorb any reverse voltages respectively developed in solenoid windings 668 and 664. Generally, the circuitry described by and associated with amplifiers 526 and 604 and Darlington 622 comprises logic and power circuit means for the control of the idle fuel metering system linear motor assembly 670 while the circuitry described by and associated with amplifiers 510 and 532 and Darlington 548 comprises logic and power circuit means for the control of the main fuel metering system linear motor assembly 666.

The diode 572 in the emitter circuit of Darlington 548 protects transistors 546 and 554 from the relatively high voltage which may be applied when throttle switch 181 is closed as during WOT operation. As shown, the throttle switch 181 may be connected as by conductor means 672 to conductor 562 leading to the source of electrical potential 174. Resistor 674 provides for the desired calibration while diode 676 provides for reverse transients. It should be apparent that the switch 181 could actually be in the form of a variable resistance (potentiometer) and/or be made to operate over any particular range or ranges of throttle opening movement.

Generally, as the magnitude of the voltage signal decreases below the set-point or reference-point established at potentiometer 592, additional current will be caused to flow through winding 664 of linear motor assembly 666 thereby causing the stem 130*c* and valve portion 142*c* to move some distance downwardly (FIG. 12) in order to increase the richness of the fuel being supplied to the fuel-air mixture being metered by the main fuel metering system. Accordingly, it can be seen that when throttle switch 181 is closed, resistor 674 may be such as to enable maximum energization of winding 664 and corresponding maximum opening of the effective orifice controlled by valve portion 142*c* and coacting aperture 144*c*.

It should be apparent that the various transducer means depicted in FIG. 1 could be arranged similarly to that shown with respect to switch 181. For example, thermistor means could be connected to either or both of terminals 642 and 576 as to thereby sense engine temperature and provide to some degree an override in controlling the energization of coils 668 and/or 664.

As can be seen, amplifier 526, in addition to being in parallel with feedback resistor 584, is also in parallel with series arranged resistor means 482 and capacitor means 484 and 486, as well as being in parallel with capacitor means 488. Likewise, amplifier 510, in addition to being in parallel with feedback resistor 582, is also in parallel with series arranged resistor means 474 and capacitor means 476 and 478, as well as being in parallel with capacitor means 480. Capacitor means 488 and 480 function in the same manner with regard to amplifiers 526 and 510 as previously described with reference to capacitor 472 of FIG. 9. Also, series resistor 482 and capacitor means 484, 486 function in the same manner with regard to amplifier 526 as previously explained with reference to resistor 466 and capacitor means 468, 470 of FIG. 9. Likewise, series resistor 474 and capacitor means 476, 478 function in the same manner with regard to amplifier 510 as previously explained with reference to resistor 466 and capacitor means 468, 470 of FIG. 9. Consequently, each of amplifiers 510 and 526, along with the described associated circuitry, provides a gain function as well as a lag and attenuation function.

Figure 12:
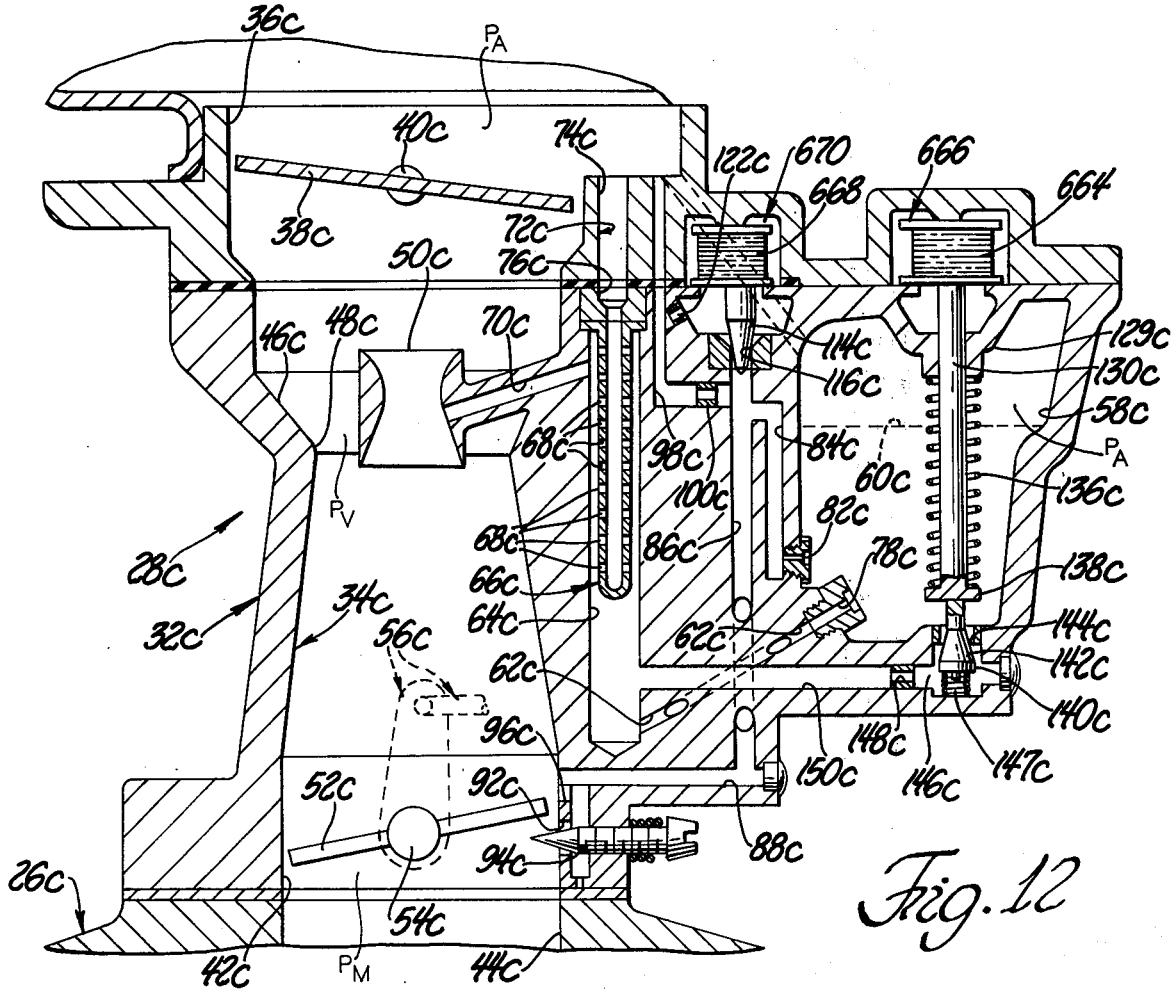
FIG. 12 is a view similar to FIG. 2 and illustrating another aspect of the invention.

FIG. 12 illustrates a carbureting structure similar to that of FIG. 2; those elements in FIG. 12 which are like or similar to those of FIG. 2 are identified with like reference numerals provided with a suffix "c". As will be apparent, the main difference between the structures of FIGS. 12 and 2 is that the valving means 670 and 666 of FIG. 12 comprise, preferably, linear type motor or solenoid assemblies having valving members 114*c* and 142*c* respectively positioned by solenoid coils 668 and 664 the energization of which has been described with reference to FIG. 10. The relative upward and downward movements of such valving portions 114*c* and 142*c* have the same functional results as their counterparts of FIG. 2.

Although only a select number of preferred embodiments and modifications of the invention have been disclosed and described, it is apparent that other embodiments and modifications of the invention are possible within the scope of the appended claims.

We claim:

1. A carburetor for a combustion engine, comprising induction passage means for supplying motive fluid to said engine, a source of fuel, main fuel metering system means communicating generally between said source of fuel and said induction passage means, idle fuel metering system means communicating generally between said source of fuel and said induction passage means, selectively controlled modulating valving means effective to controllably alter the rate of metered fuel flow through each of said main fuel metering system means and said idle fuel metering system means, and electrical circuit means effective for sensing the oxygen content within the exhaust gases of said engine and in response thereto controlling said valving means, said electrical circuit means comprising oxygen sensor means effective for sensing the relative amount of said oxygen in said exhaust gases and producing in response thereto an electrical output signal, means for comparing said output signal to a preselected reference value, amplifier means for amplifying any difference as between said preselected value and said output signal and for producing an electrical control signal effective for controlling said modulating valving means, said amplifier means comprising lag and attenuation circuit means effective for stabilizing fluctuations occurring in said output signal.

2. A carburetor according to claim 1 wherein said modulating valving means comprises electro-mechanical transducer means.

3. A carburetor according to claim 1 wherein said modulating valving means comprises pressure responsive motor means.

4. A carburetor according to claim 1 wherein said modulating valving means comprises first and second valve means, wherein said idle fuel metering system means comprises idle air bleed means, wherein said first valve means is effective to vary the effective flow area of said idle air bleed means in order to thereby alter said rate of metered fuel flow through said idle fuel metering system means, wherein said main fuel metering means, comprises metering restriction means, and wherein said second valve means is effective to vary the effective flow area of said metering restriction means to thereby alter said rate of metered fuel flow through said main fuel metering system means.

5. A carburetor according to claim 4 wherein said main fuel metering system means comprises first and second passage means communicating with said source of fuel, wherein said metering restriction means comprises first and second flow restrictor means, wherein said first and second flow restrictor means are respectively situated in said first and second passage means, wherein said second valve means is effective to vary the effective flow area of said second flow restrictor means, and wherein said second passage means communicates generally with first passage means at a point downstream of said first restrictor means.

6. A carburetor according to claim 4 wherein said idle air bleed means comprises first and second air bleed orifices, and wherein said first valve means is effective for varying the effective flow area of said first air bleed orifice.

7. A carburetor according to claim 4 wherein at least one of said first and second valve means is pressure responsive.

8. A carburetor according to claim 4 wherein said first and second valve means are each pressure responsive.

9. A carburetor according to claim 4 wherein said idle air bleed means comprises first and second air bleed orifices, wherein said first valve means is effective for varying the effective flow area of said first air bleed orifice, wherein said main fuel metering system means comprises first and second passage means communicating with said source of fuel, wherein said metering restriction means comprises first and second flow restrictor means, wherein said first and second flow restrictor means are respectively situated in said first and second passage means, wherein said second valve means is effective to vary the effective flow area of said second flow restrictor means, and wherein said second passage means communicates generally with said first passage means at a point downstream of said first restrictor means.

10. A carburetor according to claim 9 wherein said first and second valve means are pressure responsive.

11. A carburetor according to claim 1 and further comprising venturi means carried in said induction passage means, wherein said main fuel metering system means comprises main fuel discharge nozzle means situated generally in the throat of said venturi means, and further comprising variably positionable throttle valve means situated in said induction passage means, idle fuel discharge aperture means formed in a wall of said induction passage means and situated as to be generally juxtaposed to a portion of said throttle valve means.

12. A carburetor according to claim 11 wherein said main fuel metering system means further comprises a main fuel well, a first flow restrictor communicating between said source of fuel and said main fuel well, a second flow restrictor communicating between said main fuel well and said source of fuel, said first and second flow restrictors being in generally parallel flow relationship to each other, and wherein said modulating valving means is effective for varying the effective flow area of one of said first and second flow restrictors.

13. A carburetor according to claim 12 wherein said idle fuel metering system means comprises first air bleed orifice means effective for bleeding generally ambient atmospheric air into the fuel flowing through said idle fuel metering system means, and further comprising second air bleed orifice means effective for bleeding generally ambient atmospheric air into said fuel flowing through said idle fuel metering system means, and wherein said modulating valving means is effective for varying the effective flow area of said second air bleed orifice means.

14. A carburetor according to claim 13 wherein said modulating valving means comprises a first variably positionable valve member, a second variably positionable valve member, a first pressure responsive wall member operatively connected to said first valve member, a second pressure responsive wall member operatively connected to said second valve member, said first and second wall members each being adapted to be exposed to a controlled pressure differential as to be thereby urged in respective first directions, and resilient means operatively connected to said first and second valve members to yieldingly resist movement of said first and second valve members in said first direction.

15. A carburetor according to claim 14 wherein said pressure differential is at least in part determined by the magnitude of venturi vacuum generated by air flow through said venturi throat.

16. A carburetor according to claim 14 wherein said pressure differential is at least in part determined by engine vacuum communicated from said engine to said first and second pressure responsive wall members.

17. A carburetor according to claim 4 wherein said first and second valve means comprise first and second electromechanical transducer valve means.

18. A carburetor according to claim 9 wherein said first and second valve means respectively comprise first and second electro-mechanical transducer valve means.

19. A fuel metering system for a combustion engine having engine exhaust conduit means, comprising fuel carbureting means for supplying metered fuel flow to said engine, said carbureting means comprising induction passage means for supplying motive fluid to said engine, a source of fuel, main fuel metering system means communicating generally between said source of fuel and said induction passage means, idle fuel metering system means communicating generally between said source of fuel and said induction passage means, controlled modulating valving means comprising associated solenoid winding means effective to controllably alter the rate of metered fuel flow through each of said main fuel metering system means and said idle fuel metering system means, oxygen sensor means effective for sensing the relative amount of oxygen present in engine exhaust gases flowing through said exhaust conduit means and producing in accordance therewith a first output signal, and logic control means effective for receiving said first output signal and in response thereto causing said modulating means to alter said rate of metered fuel flow, said logic control means comprising first electrical buffer means for buffering said oxygen sensor means, and amplifier means for receiving an electrical signal from said buffer means and in turn creating a second output signal effective to energize said solenoid winding means in response to and in accordance with said first output signal, and additional circuit means effective for modulating the responsiveness of said amplifier means as have said second output signal modulated with respect to any pulsations appearing in said electrical signal from said buffer means.

20. A fuel metering system according to claim 19 and further comprising transducer means for sensing engine temperature and producing in response thereto a third output signal, and wherein said logic control means is effective for receiving said third output signal as an input thereto.

21. A fuel metering system according to claim 19 and further comprising variably positionable throttle valve means in said induction passage means, and transducer means for sensing when said throttle valve means is at or near a wide open condition and producing in response thereto a third output signal, and wherein said logic control means is effective for receiving said third output signal as an input thereto.

22. A fuel metering system according to claim 19 and further comprising first transducer means for sensing engine temperature and producing a third output signal in response thereto, throttle valve means situated in said induction passage means, and second transducer means for sensing when said throttle valve means is at or near a wide open condition and producing a fourth output signal in response thereto, and wherein said logic control means is effective for receiving said third and fourth output signals as inputs thereto.

23. A fuel metering system according to claim 19 and further comprising pressure transmitting conduit means effective for transmitting engine developed vacuum to said modulating valving means, and wherein said logic control means comprises pressure control valve means for regulating the magnitude of said engine vacuum applied to said modulating valving means.

24. Electrical circuit means for a fuel metering device having valving means for controlling the rate of flow of fuel into an associated engine, comprising oxygen sensor means for sensing the relative amount of oxygen present within the exhaust gases of said engine and effective for producing a first electrical output signal of a magnitude reflective of said relative amount, first electrical buffer means effective for receiving said first output signal and in response thereto creating a second output signal of related magnitude, means for establishing a preselected reference magnitude, electrical amplifier means effective to receive said second output signal and compare said related magnitude to said reference magnitude and produce an amplified third output signal of a magnitude related to the difference therebetween, solenoid winding means associated with said valving means for varying the operating position of said valving means, electrical switching means responsive to the occurrence of said third output signal for energizing said solenoid winding means in relation to the magnitude of said third output signal, and further comprising attenuating circuit means associated with said amplifier means effective to cause said third output signal to be attenuated with respect to the rate of change of said difference.

25. Electrical circuit means according to claim 24 wherein said solenoid winding means comprises first and second solenoid coils.

26. Electrical circuit means according to claim 24 wherein said amplifier means comprises first and second operational amplifiers.

27. Electrical circuit means according to claim 24 wherein said amplifier means comprises first and second operational amplifiers, wherein each of said first and second amplifiers receive said second output signal, wherein each of said first and second amplifiers produce said third output signal, wherein said switching means comprises first and second solid state switching means, wherein said first and second switching means respectively respond to said third output signals from said first and second amplifiers, wherein said solenoid winding means comprises first and second solenoid coils, and wherein said first and second switching means are respectively effective for energizing said first and second coils.

28. Electrical circuit means according to claim 24 wherein said switching means comprises transistor means situated generally between a source of electrical potential and said solenoid winding means.

29. Electrical circuit means according to claim 24 wherein said solid state switching means comprises a Darlington circuit.

30. Electrical circuit means according to claim 27 wherein each of said first and second switch means comprise Darlington circuits.

31. Electrical circuit means according to claim 27 wherein said valving means comprises first and second valving members, wherein said first valving member is effective to alter the rate of fuel flow through a first fuel metering system of said device, wherein said second valving member is effective to alter the rate of fuel flow through a second fuel metering system of said device, wherein said first solenoid coil controls said first valving member, and wherein said second solenoid coil controls said second valving member.

32. Electrical circuit means according to claim 24 and further comprising additional means responsive to indicia of engine operating conditions for energization of said solenoid winding means regardless of whether said amplifier produces said amplified third output signal.

33. Electrical circuit means according to claim 32 wherein said additional means comprises additional electrical circuit means controlled in response to the position of a throttle valve of said engine, and wherein said additional circuit means is effective to energize said solenoid winding means to a specific energization whenever said throttle valve is in a wide open position.

34. Electrical circuit means according to claim 24 and further comprising filter means generally in parallel with said amplifier means.

35. Electrical circuit means according to claim 34 wherein said filter means comprises capacitor means.

36. Electrical circuit means according to claim 24 wherein said attenuating means comprises resistor means and capacitor means arranged in series relationship to each other and in parallel relationship to said amplifier means.

37. An electrical circuit for controlling the energization of first and second solenoid coils in response to an electrical operating signal of variable magnitude, comprising first, second, third, fourth and fifth operational amplifier means, first and second transistor means comprising first Darlington circuit means, third and fourth transistor means comprising second Darlington circuit means, first and second voltage divider means, said first amplifier means being effective to receive said operating signal and to produce a first electrical output signal of a magnitude reflective of the magnitude of said operating signal, first terminal means associated with said second amplifier means and effective for receiving said first electrical output signal, second terminal means associated with said third amplifier means and effective for receiving said first electrical output signal, third terminal means associated with said second amplifier means and effectively connected to said first voltage divider means as to thereby establish a first reference magnitude for said second amplifier means, fourth terminal means associated with said third amplifier means and effectively connected to said second voltage divider means as to thereby establish a second reference magnitude for said second amplifier means, fifth terminal means associated with said second amplifier means for producing a first amplified output signal indicative of the difference in magnitudes between said first electrical output signal and said first reference magnitude, sixth terminal means associated with said fourth amplifier means and effective to receive said first amplified output signal, seventh terminal means associated with said fourth amplifier means for producing a second output signal, first base electrode means associated with said first Darlington circuit means for receiving said second output signal and in response thereto causing an output collector-emitter of said first Darlington circuit means to energize said first solenoid coil through first conductor means, eighth terminal means associated with said fourth amplifier means and electrically connected to said first conductor means, nineth terminal means associated with said third amplifier means for producing a second amplified output signal indicative of the difference in magnitudes between said first electrical output signal and said second reference magnitude, tenth terminal means associated with said fifth amplifier means and effective to receive said second amplified output signal, eleventh terminal means associated with said fifth amplifier means for producing a third output signal, second base electrode means associated with said second Darlington circuit means for receiving said third output signal and in response thereto causing an output collector-emitter of said second Darlington to energize said second solenoid coil through second conductor means, twelveth terminal means associated with said fifth amplifier means and electrically connected to said second conductor means, and attentuating circuit means associated with each of said second and third operational amplifier means effective to cause said first and second amplified output signals to be attenuated with respect to said differences, respectively.

38. An electrical circuit according to claim 37 and further comprising third conductor means electrically connected to said second conductor means and to transducer means wherein said transducer means is responsive to input signals requiring overriding of said electrical operating signal.

39. Electrical circuit means according to claim 24 and further comprising oscillator means, said oscillator means being effectively electrically interposed between said amplifier means and said switching means and effective to pulsatingly energize said solenoid winding means.

40. Electrical circuit means according to claim 39 wherein said oscillator means comprises resistor means and capacitor means forming an R-C network, and further comprising auxiliary switching means closed in response to the occurrence of selected engine operating conditions, said auxiliary switching means being effective when closed to apply additional voltage to said R-C network to thereby accordingly shorten the charging time of said capacitor means.

41. Electrical circuit means according to claim 40 wherein said auxiliary switching means comprises first and second solid state switching means, and wherein said first and second solid state switching means are closed in response to seperate ones of said selected engine operating conditions, and wherein each of said first and second solid state switching means is effective when closed to apply additional voltage to said R-C network to thereby accordingly shorten the charging time of said capacitor means.

42. Electrical circuit means according to claim 41 wherein said electrical switching means comprises Darlington circuit means.

43. Electrical circuit means according to claim 41 wherein said valving means are each fluid pressure actuated, wherein pressure controller valve assembly means are employed for establishing a selectable magnitude of said fluid pressure, and wherein said controller valve assembly means comprises as a portion thereof said solenoid winding means.

44. Electrical circuit means according to claim 41 wherein said first solid state switching means comprises first transistor means, wherein said second solid state switching means comprises second transistor means, and further comprising first transducer means responsive to one of said engine operating conditions for at times making said first transistor conductive, and second transducer means responsive to an other of said engine operating conditions for at times making said second transistor conductive.

45. Electrical circuit means according to claim 44 wherein said first transducer means is responsive to the temperature of said engine, and wherein said second transducer means is responsive to the degree of opening of a throttle valve associated with said fuel metering device.

* * * * *